US010287696B2

(12) United States Patent
Kaczur et al.

(10) Patent No.: US 10,287,696 B2
(45) Date of Patent: May 14, 2019

(54) PROCESS AND HIGH SURFACE AREA ELECTRODES FOR THE ELECTROCHEMICAL REDUCTION OF CARBON DIOXIDE

(71) Applicant: Liquid Light, Inc., Monmouth Junction, NJ (US)

(72) Inventors: Jerry J. Kaczur, North Miami Beach, FL (US); Theodore J. Kramer, New York, NY (US); Kunttal Keyshar, Houston, TX (US); Paul Majsztrik, Cranbury, NJ (US); Zbigniew Twardowski, Burnaby (CA)

(73) Assignee: Avantium Knowledge Centre B.V., Amsterdam (NL)

( * ) Notice: Subject to any disclaimer, the term of this patent is extended or adjusted under 35 U.S.C. 154(b) by 524 days.

(21) Appl. No.: 14/471,152

(22) Filed: Aug. 28, 2014

(65) Prior Publication Data

US 2014/0367273 A1 Dec. 18, 2014

Related U.S. Application Data

(62) Division of application No. 13/724,885, filed on Dec. 21, 2012, now Pat. No. 8,858,777.

(Continued)

(51) Int. Cl.
*C25B 3/04* (2006.01)
*C07C 17/00* (2006.01)

(Continued)

(52) U.S. Cl.
CPC ..... *C25B 15/08* (2013.01); *C25B 3/04* (2013.01); *C25B 9/08* (2013.01); *C25B 9/10* (2013.01); *C25B 11/0478* (2013.01); *C25B 15/00* (2013.01)

(58) Field of Classification Search
CPC ..... C07C 17/00; C25B 3/04

(Continued)

(56) References Cited

U.S. PATENT DOCUMENTS 1,280,622 A 10/1918 Andrews
1,962,140 A 6/1934 Dreyfus (Continued)

FOREIGN PATENT DOCUMENTS

CA 1146120 A1 5/1983
CA 1272161 A1 7/1990

(Continued)

OTHER PUBLICATIONS

Oloman et al., "Electrochemical Processing of Carbon Dioxide," ChemSusChem (no month, 2008), vol. 1, pp. 385-391.*

(Continued)

*Primary Examiner* — Edna Wong
(74) *Attorney, Agent, or Firm* — Suiter Swantz pc llo

(57) ABSTRACT

Methods and systems for electrochemical conversion of carbon dioxide to organic products including formate and formic acid are provided. A method may include, but is not limited to, steps (A) to (C). Step (A) may introduce an acidic anolyte to a first compartment of an electrochemical cell. The first compartment may include an anode. Step (B) may introduce a bicarbonate-based catholyte saturated with carbon dioxide to a second compartment of the electrochemical cell. The second compartment may include a high surface area cathode including indium and having a void volume of between about 30% to 98%. At least a portion of the bicarbonate-based catholyte is recycled. Step (C) may apply an electrical potential between the anode and the cathode sufficient to reduce the carbon dioxide to at least one of a single-carbon based product or a multi-carbon based product.

13 Claims, 21 Drawing Sheets

Related U.S. Application Data

(60) Provisional application No. 61/701,237, filed on Sep. 14, 2012, provisional application No. 61/703,158, filed on Sep. 19, 2012, provisional application No. 61/703,175, filed on Sep. 19, 2012, provisional application No. 61/703,231, filed on Sep. 19, 2012, provisional application No. 61/703,232, filed on Sep. 19, 2012, provisional application No. 61/703,234, filed on Sep. 19, 2012, provisional application No. 61/703,238, filed on Sep. 19, 2012, provisional application No. 61/703,187, filed on Sep. 19, 2012, provisional application No. 61/720,670, filed on Oct. 31, 2012, provisional application No. 61/703,229, filed on Sep. 19, 2012, provisional application No. 61/675,938, filed on Jul. 26, 2012.

(51) Int. Cl.

| | |
|---|---|
| ***C25B 15/08*** | (2006.01) |
| ***C25B 11/04*** | (2006.01) |
| ***C25B 9/10*** | (2006.01) |
| ***C25B 9/08*** | (2006.01) |
| ***C25B 15/00*** | (2006.01) |

(58) Field of Classification Search

USPC ..... 570/101; 205/345, 440, 465, 510, 618, 205/619, 349, 480

See application file for complete search history.

(56) References Cited

U.S. PATENT DOCUMENTS 2,060,880 A 11/1936 Lazier et al.
3,019,256 A 1/1962 Dunn
3,088,990 A 5/1963 Rightmire et al.
3,220,941 A 11/1965 Osborne et al.
3,236,879 A 2/1966 Chiusoli
3,293,292 A 12/1966 Olivier et al.
3,326,998 A 6/1967 Reusser et al.
3,341,615 A 9/1967 Wulf et al.
3,341,616 A 9/1967 Vives
3,344,046 A 9/1967 Neikam
3,347,758 A 10/1967 Koehl, Jr.
3,352,935 A 11/1967 Mahan
3,361,653 A 1/1968 Miller
3,401,100 A 9/1968 Macklin
3,492,209 A 1/1970 Miller
3,531,386 A 9/1970 Heredy
3,560,354 A 2/1971 Young
3,607,962 A 9/1971 Krekeler et al.
3,636,159 A 1/1972 Solomon
3,720,591 A 3/1973 Skarlos
3,745,180 A 7/1973 Rennie
3,764,492 A 10/1973 Baizer et al.
3,779,875 A 12/1973 Michelet
3,824,163 A 7/1974 Maget
3,894,059 A 7/1975 Selvaratnam
3,959,094 A 5/1976 Steinberg
4,072,583 A 2/1978 Hallcher et al.
4,087,470 A 5/1978 Suzuki
4,088,682 A 5/1978 Jordan
4,147,599 A 4/1979 O'Leary et al.
4,162,948 A 7/1979 Yagii et al.
4,219,392 A 8/1980 Halmann
4,245,114 A 1/1981 Peltzman
4,253,921 A 3/1981 Baldwin et al.
4,256,550 A 3/1981 Niinobe et al.
4,267,070 A 5/1981 Nefedov et al.
4,299,981 A 11/1981 Leonard
4,334,967 A 6/1982 Tedoradze et al.
4,343,690 A 8/1982 De Nora
4,381,978 A 5/1983 Gratzel et al.
4,384,084 A 5/1983 Lohse et al.
4,421,613 A 12/1983 Goodridge et al.
4,450,055 A 5/1984 Stafford
4,476,003 A 10/1984 Frank et al.
4,510,214 A 4/1985 Crouse et al.
4,523,981 A 6/1985 Ang et al.
4,545,866 A 10/1985 De Nora et al.
4,547,271 A 10/1985 Bharucha et al.
4,560,451 A 12/1985 Nielsen
4,563,254 A 1/1986 Morduchowitz et al.
4,589,963 A 5/1986 Cipriano et al.
4,595,465 A 6/1986 Ang et al.
4,608,132 A 8/1986 Sammells
4,608,133 A 8/1986 Morduchowitz et al.
4,619,743 A 10/1986 Cook
4,661,422 A 4/1987 Marianowski et al.
4,673,473 A 6/1987 Ang et al.
4,702,973 A 10/1987 Marianowski
4,732,655 A 3/1988 Morduchowitz et al.
4,756,807 A 7/1988 Meyer et al.
4,810,596 A 3/1989 Ludwig
4,845,252 A 7/1989 Schmidt et al.
4,902,828 A 2/1990 Wickenhaeuser et al.
4,950,368 A 8/1990 Weinberg et al.
4,968,393 A 11/1990 Mazur et al.
5,074,974 A 12/1991 Toomey, Jr.
5,084,148 A 1/1992 Kazcur et al.
5,096,054 A 3/1992 Scherson
5,106,465 A 4/1992 Kaczur et al.
5,107,040 A 4/1992 Repman et al.
5,155,256 A 10/1992 Chapman
5,198,086 A * 3/1993 Chlanda ..... B01D 61/445 204/534
5,198,311 A 3/1993 Nakazawa et al.
5,246,551 A 9/1993 Pletcher et al.
5,290,404 A 3/1994 Toomey
5,300,369 A 4/1994 Dietrich et al.
5,294,319 A 5/1994 Kaczur et al.
5,412,150 A 5/1995 Wessel
5,443,804 A 8/1995 Parker et al.
5,455,372 A 10/1995 Hirai et al.
5,474,658 A 12/1995 Scharbert et al.
5,514,492 A 5/1996 Marincic et al.
5,536,856 A 7/1996 Harrison et al.
5,654,493 A 8/1997 Wessel
5,804,045 A 9/1998 Orillon et al.
5,961,813 A 10/1999 Gestermann et al.
6,001,500 A 12/1999 Bass et al.
6,024,935 A 2/2000 Mills et al.
6,137,005 A 10/2000 Honevik
6,171,551 B1 1/2001 Malchesky et al.
6,251,256 B1 6/2001 Blay et al.
6,312,655 B1 11/2001 Hesse et al.
6,348,613 B2 2/2002 Miyamoto et al.
6,380,446 B1 4/2002 Drew et al.
6,465,699 B1 10/2002 Grosso
6,492,047 B1 12/2002 Peled et al.
6,777,571 B2 8/2004 Chaturvedi et al.
6,881,320 B1 4/2005 Krafton et al.
6,949,178 B2 9/2005 Tennakoon et al.
7,138,201 B2 11/2006 Inoue et al.
7,462,752 B2 12/2008 Fong et al.
7,883,610 B2 2/2011 Monzyk et al.
8,227,127 B2 7/2012 Little et al.
8,277,631 B2 10/2012 Eastman et al.
8,313,634 B2 11/2012 Bocarsly et al.
8,444,844 B1 5/2013 Teamey et al.
8,562,811 B2 10/2013 Sivasankar et al.
8,663,447 B2 3/2014 Bocarsly et al.
8,721,866 B2 5/2014 Sivasankar et al.
9,090,976 B2 7/2015 Bocarsly et al.
2001/0001798 A1 5/2001 Sharpless et al.
2001/0026884 A1 10/2001 Appleby et al.
2002/0013477 A1 1/2002 Kim et al.
2002/0022753 A1 2/2002 Drew et al.
2002/0122980 A1 9/2002 Fleischer et al.
2004/0006246 A1 1/2004 Sherman et al.
2004/0115489 A1 6/2004 Goel
2005/0139486 A1 6/2005 Carson et al.
2005/0245784 A1 11/2005 Carson et al.
2006/0102468 A1 5/2006 Monzyk et al.

(56) References Cited

U.S. PATENT DOCUMENTS

2006/0269813 A1 11/2006 Seabaugh et al.
2007/0004023 A1 1/2007 Trachtenberg et al.
2007/0012577 A1 1/2007 Bulan et al.
2007/0224479 A1 9/2007 Tadokoro et al.
2008/0223727 A1* 9/2008 Oloman ..... B01D 53/326 205/413
2008/0245660 A1 10/2008 Little et al.
2008/0248350 A1 10/2008 Little et al.
2008/0283411 A1 11/2008 Eastman et al.
2008/0286643 A1 11/2008 Iwasaki
2008/0296146 A1 12/2008 Toulhoat et al.
2008/0314758 A1 12/2008 Grosso
2009/0000956 A1 1/2009 Weidner et al.
2009/0014336 A1 1/2009 Olah et al.
2009/0030240 A1 1/2009 Olah et al.
2009/0057161 A1 3/2009 Aulich et al.
2009/0062110 A1 3/2009 Koshino et al.
2009/0156867 A1 6/2009 Van Kruchten
2009/0308759 A1* 12/2009 Waycuilis ..... C25B 1/24 205/619
2010/0051859 A1 3/2010 House et al.
2010/0061922 A1 3/2010 Rauser et al.
2010/0069600 A1 3/2010 Morelle et al.
2010/0130768 A1 5/2010 Sato et al.
2010/0140103 A1 6/2010 Gilliam et al.
2010/0187123 A1 7/2010 Bocarsly et al.
2010/0187125 A1 7/2010 Sandoval et al.
2010/0191024 A1 7/2010 Uenveren et al.
2010/0196800 A1 8/2010 Markoski et al.
2010/0248042 A1 9/2010 Nakagawa et al.
2010/0270167 A1 10/2010 McFarland
2010/0282614 A1 11/2010 Detournay et al.
2010/0305629 A1 12/2010 Lund et al.
2010/0330435 A1 12/2010 Nemeth et al.
2011/0024288 A1 2/2011 Bhavaraju et al.
2011/0083968 A1 4/2011 Gilliam et al.
2011/0114501 A1 5/2011 Teamey et al.
2011/0114502 A1 5/2011 Cole et al.
2011/0114503 A1 5/2011 Sivasankar et al.
2011/0114504 A1 5/2011 Sivasankar et al.
2011/0143224 A1 6/2011 Rittmann et al.
2011/0143929 A1 6/2011 Sato et al.
2011/0177398 A1 7/2011 Affinito et al.
2011/0186441 A1 8/2011 LaFrancois et al.
2011/0217226 A1 9/2011 Mosa et al.
2011/0226632 A1 9/2011 Cole et al.
2011/0237830 A1 9/2011 Masel
2011/0303551 A1 12/2011 Gilliam et al.
2011/0318617 A1 12/2011 Kirchev et al.
2012/0004448 A1 1/2012 Bhattacharyya et al.
2012/0004449 A1 1/2012 Bhattacharyya
2012/0004454 A1 1/2012 Bhattacharyya et al.
2012/0018311 A1 1/2012 Yotsuhashi et al.
2012/0043301 A1 2/2012 Arvin et al.
2012/0132537 A1 5/2012 Sivasankar et al.
2012/0132538 A1 5/2012 Cole et al.
2012/0199493 A1 8/2012 Krafft et al.
2012/0215034 A1 8/2012 McFarland
2012/0228147 A1* 9/2012 Sivasankar ..... C25B 1/003 205/440
2012/0277465 A1 11/2012 Cole et al.
2012/0292196 A1 11/2012 Albrecht et al.
2012/0295172 A1 11/2012 Peled et al.
2012/0298522 A1 11/2012 Shipchandler et al.
2012/0329657 A1 12/2012 Eastman et al.
2013/0062216 A1 3/2013 Yotsuhashi et al.
2013/0098772 A1 4/2013 Bocarsly et al.
2013/0105304 A1 5/2013 Kaczur et al.
2013/0105330 A1 5/2013 Teamey et al.
2013/0118907 A1 5/2013 Deguchi et al.
2013/0118909 A1 5/2013 Kaczur et al.
2013/0118911 A1 5/2013 Sivasankar et al.
2013/0134048 A1 5/2013 Teamey et al.
2013/0134049 A1 5/2013 Teamey et al.
2013/0137898 A1 5/2013 Teamey et al.
2013/0140187 A1 6/2013 Teamey et al.
2013/0180863 A1 7/2013 Kaczur et al.
2013/0180865 A1 7/2013 Cole et al.
2013/0186771 A1 7/2013 Zhai et al.
2013/0199937 A1 8/2013 Cole et al.

FOREIGN PATENT DOCUMENTS

CA 2043256 A1 12/1991
CA 2391938 A1 5/2001
CN 101743343 A 6/2010
CN 102190573 A 9/2011
DE 1047765 A 12/1958
DE 2301032 A 7/1974
EP 0028430 A1 5/1981
EP 2329875 A1 6/2011
FR 853643 3/1940
GB 1096847 A 12/1967
GB 1223452 A 2/1971
GB 1285209 A 8/1972
GB 1584524 A 4/1977
GB 2038335 A 7/1980
GB 2312218 A 10/1997
JP 48029721 4/1973
JP 50052010 5/1975
JP 53101311 4/1978
JP 64-015388 1/1989
JP 7-75784 10/1996
JP 7-118886 10/1996
JP 2000104190 4/2000
JP 2004533545 11/2004
JP 2009540130 11/2009
JP 2012516392 A 7/2012
WO 1991/001947 A1 2/1991
WO WO 9724320 A1 7/1997
WO 1998050974 A1 11/1998
WO WO 2000015586 A1 3/2000
WO WO2001038275 A1 5/2001
WO 2003004727 A2 1/2003
WO WO 200467673 A1 8/2004
WO 2006074335 A2 7/2006
WO 2007041872 A1 4/2007
WO WO 2007041872 A1 4/2007
WO 2007/091616 A1 8/2007
WO 2007145586 A1 12/2007
WO WO 2007145586 A1 * 12/2007 ..... B01J 21/063
WO 2009012154 A2 1/2009
WO 2009108327 A1 9/2009
WO 2011069008 6/2011
WO 2011116236 A2 9/2011
WO 2011160577 A1 12/2011
WO 2012015921 A1 2/2012
WO WO 2012046362 A1 4/2012
WO 2012118065 A1 9/2012
WO 2012166997 A2 12/2012

OTHER PUBLICATIONS

Treffry-Goatley et al., "The Application of Nanofiltration Membranes to the Treatment of Industrial Effluent and Process Streams," Filtration & Separation (Jan.-Feb. 1993), vol. 30, Issue 1, pp. 63-66.*

Oloman et al., "Electrochemical Processing of Carbon Dioxide," ChemSusChem (2008), vol. 1, pp. 385-391. (Year: 2008).*

Treffry-Goatley et al., "The Application of Nanofiltration Membranes to the Treatment of Industrial Effluent and Process Streams," Filtration & Separation (Jan.-Feb. 1993), vol. 30, Issue 1, pp. 63-66. (Year: 1993).*

Seshardi G., Lin C., Bocarsly A.B., A new homogeneous electrocatalyst for the reduction of carbon dioxide to methanol at low overpotential, Journal of Electroanalytical Chemistry, 1994, 372, pp. 145-150.

Chen et al., "Tin oxide dependence of the CO2 reduction efficiency on tin electrodes and enhanced activity for tin/tin oxide thin-film catalysts." Journal of the American Chemical Society 134, No. 4 (2012): 1986-1989, Jan. 9, 2012, retrieved on-line.

(56) References Cited

OTHER PUBLICATIONS

Zhou et al. "Anodic passivation processes of indium in alkaline solution [J]" Journal of Chinese Society for Corrosion and Protection 1 (2005): 005, Feb. 2005.
Fukaya et al., "Electrochemical Reduction of Carbon Dioxide to Formate Catalyzed by Rh(bpy)3CI3", Kagaku Gijutsu Kenkyusho Hokoku (no month, 1986), vol. 81, No. 5, pp. 255-258.
James Grimshaw, Electrochemical Reactions and Mechanisms in Organic Chemistry, 2000, ISBN 978-0-444-72007-8. [retrieved on Jan. 3, 2014]. Retrieved from the internet. <URL: http://f3.tiera.ru/ShiZ/Great%20Science%20TextBooks/Great%Science%20Textbooks%20DVD%20Library%202007%20-%20Supplement%20Five/Chemistry/Organic%20Chemistry/Electrochemical%20Reactions%20and%20Mechanisms%20in%20Organic%20Chemistry%20-%20J.%20Grimshaw%20%28Elsevier,%202000%29%WW.pdf>.
Fischer, J. et al. "The production of oxalic acid from CO2 and H2O." Journal of Applied Electrochemistry, 1981, vol. 11, pp. 743-750.
Goodridge, F. et al., The electrolytic reduction of carbon dioxide and monoxide for the production of carboxylic acids.: Journal of applied electrochemistry, 1984, vol. 14, pp. 791-796.
Seshadri et al, "A new homogeneous catalyst for the reduction of carbon dioxide to methanol at low overpotential," Journal of Electroanalytical Chemistry, 372 (1994) 145-150.
Scibioh et al, "Electrochemical Reduction of Carbon Dioxide: A Status Report," Proc. Indian Natn Science Acad., 70, A, No. 3, May 2004, pp. 407-762.
Hori et al, "Enhanced Formation of Ethylene and Alcohols at Ambient Temperature and Pressure in Electrochemical Reduction of Carbon Dioxide at a Copper Electrode," J. Chem. Soc. Chem. Commun. (1988), pp. 17-19.
Hossain et al, "Palladium and Cobalt Complexes of Substituted Quinoline, Bipyridine and Phenanthroline as Catalysts for Electrochemical Reduction of Carbon Dioxide," Electrochimica Acta, vol. 42, No. 16 (1997), pp. 2577-2585.
Fischer, "Liquid Fuels from Water Gas", Industrial and Engineering Chemistry, vol. 17, No. 6, Jun. 1925, pp. 574-576.
Williamson et al, "Rate of Absorption and Equilibrium of Carbon Dioxide in Alkaline Solutions", Industrial and Engineering Chemistry, vol. 16, No. 11, Nov. 1924, pp. 1157-1161.
Hori, "Electrochemical CO2 Reduction on Metal Electrodes", Modern Aspects of Electrochemistry, No. 42, 2008, pp. 89-189.
Green et al., "Vapor-Liquid Equilibria of Formaldehyde-Methanol-Water", Industrial and Engineering Chemistry (Jan. 1955), vol. 47, No. 1, pp. 103-109.
Shibata et al., "Electrochemical Synthesis of Urea at Gas-Diffusion Electrodes Part VI. Simultaneous Reduction of Carbon Dioxide and Nitrite Ions with Various Metallophthalocyanine Catalysts". J. of Electroanalytical Chemistry (no month, 2001), vol. 507, pp. 177-184.
Jaaskelainen and Haukka, The Use of Carbon Dioxide in Ruthenium Carbonyl Catalyzed 1-hexene Hydroformylation Promoted by Alkali Metal and Alkaline Earth Salts, Applied Catalysis A: General, 247, 95-100 (2003).
Heldebrant et al., "Reversible Zwitterionic Liquids, The Reaction of Alkanol Guanidines, Alkanol Amidines, and Diamines wih CO2", Green Chem. (mo month, 2010), vol. 12, pp. 713-721.
Perez et al., "Activation of Carbon Dioxide by Bicyclic Amidines", J. Org. Chem. (no month, 2004), vol. 69, pp. 8005-8011.
Nefedov and Manov-Yuvenskii, The Effect of Pyridine Bases and Transition-Metal Oxides on the Activity of PdCl2 in the Carbonylation of Aromatic Mononitro Compounds by Carbon Monoxide, 28 Bulletin of the Acad. Of Sciences of the USSR 3, 540-543 (1979).
Vojinovic "Bromine oxidation and bromine reduction in propylene carbonate" Journal of Electroanalytical Chemistry, 547 (2003) p. 109-113.
Babic et al (Electrochimica Acta, 51, 2006, 3820-3826).
Yoshida et al. (Journal of Electroanalytical Chemistry, 385, 1995, 209-225).
Kaneco et al., "Electrochemical Conversion of Carbon Dioxide to Formic Acid on Pb in KOH/Methanol Electrolyte at Ambient Temperature and Pressure", Energy (no month, 1998), vol. 23, No. 12, pp. 1107-1112.
Wu et al., "Electrochemical Reduction of Carbon Dioxide I. Effects of the Electrolyte on the Selectivity and Activity with Sn Electrode", Journal of the Electrochemical Society (no month, 2012), vol. 159, No. 7, pp. F353-F359.
Chaplin et al., "Effects of Process Conditions and Electrode Material on Reaction Pathways for Carbon Dioxide Electroreduction with Particular Reference to Formate Formation", Journal of Applied Electrochemistry (no month, 2003), vol. 33, pp. 1107-1123.
Jaime-Ferrer et al., "Three-Compartment Bipolar Membrane Electrodialysis for Splitting of Sodium Formate into Formic Acid and Sodium Hydroxide: Role of Diffusion of Molecular Acid", Journal of Membrane Science (no month, 2008), vol. 325, pp. 528-536.
Tinnemans et al., "Tetraaza-macrocyclic cobalt(II) and nickel(II) complexes as electron-transfer agents in the photo (electro)chemical and electrochemical reduction of carbon dioxide," Recl.Trav. Chim. Pays-Bas, Oct. 1984, 103: 288-295.
Bocarsly et al., "Photoelectrochemical conversion of carbon dioxide to methanol and higher alcohols, a chemical carbon sequestration strategy," Preprints of Symposia—American Chemical Society, Division of Fuel Chemistry, vol. 53, Issue: 1, pp. 240-241.
Scibioh et al, "Electrochemical Reductin of Carbon Dioxide: A Status Report," Proc. Indian Natn Science Acad., 70, A, No. 3, May 2004, pp. 407-762.
Fukaya et al., "Electrochemical Reduction of Carbon Dioxide to Formate Catalyzed by Rh(bpy)3CI3", Kagaku Gijutsu Kenkyusho Hokoku (no month, 1986), vol. 81, No. 5, pp. 255-258. 1-page abstract only.
Li et al., "the Electro-Reduction of Carbon Dioxide in a Continuous Reactor", J. of Applied Electrochemistry (no month, 2005), vol. 35, pp. 955-965.
Kaneco et al., "Electrochemical Reduction of Carbon Dioxide to Ethylene with High Faradaic Efficiency at a Cu Electrode in CsOH/Methanol", Electrochimica Acta (no month, 1999), vol. 44, pp. 4701-4706.
Yuan et al., "Electrochemical Activation of Carbon Dioxide for Synthesis of Dimethyl Carbonate in an Ionic Liquid", Electrochimica Acta (no month, 2009), vol. 54, pp. 2912-2915.
U.S. Appl. No. 13/724,647, filed Dec. 21, 2012; Office Action dated Oct. 17, 2013.
U.S. Appl. No. 13/787,481, filed Mar. 6, 2013; Office Action dated Sep. 13, 2013.
U.S. Appl. No. 13/724,082, filed Dec. 21, 2012; Office Action dated Aug. 12, 2013.
U.S. Appl. No. 13/724,522, filed Dec. 21, 2012; Office Action dated Oct. 1, 2013.
U.S. Appl. No. 13/724,885, filed Dec. 21, 2012; Office Action dated Aug. 21, 2013.
U.S. Appl. No. 13/724,231, filed Dec. 21, 2012; Office Action dated Aug. 20, 2013.
B. Eneau-Innocent et al., Electroreduction of carbon dioxide at a lead electrode in propylene carbonate: A spectroscopic study, Applied Catalysis B: Environmental 98 (2010) 65-71.
Kotaro Ogura et al., Selective Conversion of CO2 to Ethylene by the Electrolysis at a Three-Phase (Gas/Liquid/Solid) Interface in an Acidic Solution Containing Cupric Ions, Fuel Chemistry Division Preprints 2003, 48(1), 264.
S. Gambino and G. Silvestri, On the electrochemical reduction of carbon dioxide and ethylene, Tetrahedron Letters No. 32, pp. 3025-3028, 1973, Pergamon Press, Printed in Great Britain.
K.S. Udupa, G.S. Subramanian, and H.V.K. Udupa, The electrolytic reduction of carbon dioxide to formic acid, Electrochimica Acta, 1971, vol. 16, pp. 1593 to 1598, Pergamon Press, Printed in Northern Ireland.
A. Sepulveda-Escribano et al., Platinum catalysts supported on carbon blacks with different surface chemical properties, Applied Catalysis A: General, 173, 1998, p. 247-257.

(56) References Cited

OTHER PUBLICATIONS

F.M. Al Kharafi et al., Electrochemical Oxidation of Sulfide Ions on Platinum Electrodes, Modern Applied Science, vol. 4, No. 3, Mar. 2010, pp. 2-11.
P.W.T. Lu, et al., Recent developments in the technology of sulphur dioxide depolarized electrolysis, Journal of Applied Electrochemistry, vol. 11, No. 3, May 1981, pp. 347-355.
Seshadri, Part I Electrocatalysis at modified semiconductor and metal electrodes; Part II Electrochemistry of nickel and cadmium hexacyanoferrates, Diss. Abstr. Int. B 1994, 54(12, Pt. 1), 6198, pp. 52-85.
Cuihong Yan et al., The Lastest Research Progress of Electrocatalytic Reduction Product of CO2, Chemical Engineer, Issue 7, p. 42-45, Jul. 25, 2010.
Yingchu Tao et al., Research Progress of Electrochemical Reduction of Carbon Dioxide, Chemistry, Issue 5, p. 272-277, Dec. 31, 2001, http://chemistrymag.org.
Wenying Wei et al., The research progress of CO2 electrocatalysis in water soluble medium, Progress in Chemistry, col. 26, Issue 2, 4 pages, Dec. 2008.
Matayoshi et al., Electrochemical Reforming of CH4—CO2 Gas Using Porous Gd-Doped Ceria Electrolyte with Ni and Ru Electrodes, Journal of the Ceramic Society of Japan, vol. 117, 2009, pp. 1107-1112, Abstract Only.
Koeleli et al., Electrochemical Reduction of CO2 at Pb- and Sn-Electrodes in a Fixed-Bed Reactor in Aqueous K2CO3 and KHCO3 Media, Journal of Applied Electrochemistry, vol. 33, No. 5, 2003, pp. 447-450, Abstract Only.
Cao et al., Electrocatalytic Reduction of Carbon Dioxide Using Cobalt Tetrakis(4-Trimethylammoniophenyl)porphyrin Iodide Under High Pressure, Huazue Xuebao, vol. 44, No. 3, 1986, pp. 220-224, Abstract Only.
T. Meisel et al., The thermal decomposition of alkali metal formates, Journal of Thermal Analysis, vol. 7, No. 1, Feb. 1, 1975, pp. 73-80.
Cole, EB et al., Using a One-Electron Shuttle for the Multielectron Reduction of CO2 to Methanol: Kinetic, Mechanistic, and Structural Insights, Journal of the American Chemical Society, Jul. 28, 2010, vol. 132, pp. 11539-11551.
Hori et al, chapter on "Electrochemical CO2 Reduction on Metal Electrodes," in the book "Modern Aspects of Electrochemistry," vol. 42, pp. 106 and 107.
Czerwinski et al, "Adsorption Study of CO2 on Reticulated vitreous carbon (RVC) covered with platinum," Analytical Letters, vol. 18, Issue 14 (1985), pp. 1717-1722.
Hammouche et al, Chemical Catalysis of Electrochemical Reactions. Homogeneous Catalysis of the Electrochemical Reduction of Carbon Dioxide by Iron ("0") Porphyrins. Role of the Addition of Magnesium Cations. J. Am. Chem. Soc. 1991, 113, 8455-8466.
Hossain et al., Palladium and Cobalt Complexes of Substituted Quinoline, Bipyridine and Phenanthroline as Catalysts for Electrochemical Reduction of Carbon Dioxide, Electrochimica Acta (no month, 1997), vol. 42, No. 16, pp. 2577-2785.
Scibioh et al., "Electrochemical Reduction of Carbon Dioxide: A Status Report", Proc Indian Natn Sci Acad (May 2004), vol. 70, A, No. 3, pp. 407-462.
Seshadri et al., A New Homogeneous Electrocatalyst for the Reduction of Carbon Dioxide to Methanol at Low Overpotential, Journal of Electroanalytical Chemistry, 372 (1994), 145-50.
Gennaro et al., Homogeneous Electron Transfer Catalysis of the Electrochemical Reduction of Carbon Dioxide. Do Aromatic Anion Radicals React in an Outer-Sphere Manner?, J. Am. Chem. Soc. (no month, 1996), vol. 118, pp. 7190-7196.
Zaragoza Dorwald, Side Reactions in Organic Synthesis, 2005, Wiley-VCH Verlag GmbH & Co. KGaA, Weinheim, Preface. p. IX.
Liansheng et al, Journal of South Central University Technology, Electrode Selection of Electrolysis with Membrane for Sodium Tungstate Solution, 1999, 6(2), pp. 107-110.
Mahmood et al., Use of Gas-Diffusion Electrodes for High-Rate Electrochemical Reduction of Carbon Dioxide. II. Reduction at Metal Phthalocyanine-Impregnated Electrodes, J. of Appl. Electrochem. (no month, 1987), vol. 17, pp. 1223-1227.
Tanno et al., Electrolysis of Iodine Solution in a New Sodium Bicarbonate-Iodine Hybrid Cycle, International Journal of Hydrogen Energy (no month, 1984), vol. 9, No. 10, pp. 841-848.
Eggins, Brown, McNeill, and Grimshaw, Carbon Dioxide Fixation by Electrochemical Reduction in Water to Oxalate and Glyoxylate, Tetrahedron Letters vol. 29, No. 8, pp. 945-948, 1988, Pergamon Journals Ltd., Printed in Great Britain.
M. Alvarez-Guerra et al., Conversion of carbon dioxide into formate using a continuous electrochemical reduction process in a lead cathode, Chem. Eng. J. (2012), http://dx.doi.org/10.1016/j.cej.2012.06.099.
Afroza Begum, Electrochemical CO2 Reduction, Thesis, 2011, University of Newfoundland, http://collections.mun.ca/cdm4/document.php?CISOROOT=/theses5&CISOPTR=14718&REC=7.
Satoshi Kaneco, Kenji Iiba, Nobu-Hide Hiei, Kiyohisa Ohta, Takayuki Mizuno, and Tohru Suzuki, Electrochemical reduction of carbon dioxide to ethylene with high Faradaic efficiency at a Cu electrode in CsOH/methanol, Electrochimica Acta 44 (1999) 4701-4706.
Keith Scott, A Preliminary Investigation of the Simultaneous Anodic and Cathodic Production of Glyoxylic Acid, Electrochimica Acta, vol. 36, No. 9, pp. 1447-1452, 1991, Printed in Great Britain.
Seshadri et al., "A new homogeneous electrocatalyst for the reduction of carbon dioxide to methanol at low overpotential", Journal of Electroanalytical Chemistry and Interfacial Electro Chemistry, Elsevier, Amsterdam, NL, vol. 372, No. 1-2, Jul. 8, 1994, pp. 145-150.
Hossain et al., "Palladium and cobalt complexes of substituted quinoline, bipyridine and phenanthroline as catalysts for electrochemical reduction of carbon dioxide", Electrochimica Acta, Elsevier Science Publishers, vol. 42, No. 16, Jan. 1, 1997, pp. 2577-2585.
Fisher et al., "Electrocatalytic reduction of carbon dioxide by using macrocycles of nickel and cobalt", Journal of the American Chemical Society, vol. 102, No. 24, Sep. 1, 1980, pp. 7361-7363.
Ishida et al., Selective Formation of HC00—In the Electrochemical CO2 Reduction Catalyzed by URU(BPY)2(CO)2 3/4 2+ (BPY=2,2'-Bipyridine), Journal of the Chemical Society, Chemical Communications, Chemical Society, Letchworth, GB, Jan. 1, 1987, pp. 131-132.
Zhao et al., "Electrochemical reduction of supercritical carbon dioxide in ionic liquid 1-n-butyl-3-methylimidazolium hexafluorophosphate", Journal of Supercritical Fluids, PRA Press, US, vol. 32, No. 1-3, Dec. 1, 2004, pp. 287-291.

* cited by examiner

PROCESS AND HIGH SURFACE AREA ELECTRODES FOR THE ELECTROCHEMICAL REDUCTION OF CARBON DIOXIDE

CROSS-REFERENCE TO RELATED APPLICATIONS

The present application claims priority under 35 U.S.C. § 120 of U.S. patent application Ser. No. 13/724,885, filed Dec. 21, 2012, now U.S. Pat. No. 8,858,777, which is hereby incorporated by reference in its entirety.

The U.S. patent application Ser. No. 13/724,885, filed Dec. 21, 2012 claims the benefit under 35 U.S.C. § 119(e) of U.S. Patent Application Ser. No. 61/701,237, filed Sep. 14, 2012, which is hereby incorporated by reference in its entirety.

The U.S. patent application Ser. No. 13/724,885, filed Dec. 21, 2012 also claims the benefit under 35 U.S.C. § 119(e) of U.S. Provisional Application Ser. No. 61/703,158 filed Sep. 19, 2012, U.S. Provisional Application Ser. No. 61/703,175 filed Sep. 19, 2012, U.S. Provisional Application Ser. No. 61/703,231 filed Sep. 19, 2012, U.S. Provisional Application Ser. No. 61/703,232, filed Sep. 19, 2012, U.S. Provisional Application Ser. No. 61/703,234, filed Sep. 19, 2012, U.S. Provisional Application Ser. No. 61/703,238 filed Sep. 19, 2012, U.S. Provisional Application Ser. No. 61/703,187 filed Sep. 19, 2012, U.S. Provisional Application Ser. No. 61/720,670 filed Oct. 31, 2012, U.S. Provisional Application Ser. No. 61/703,229 filed Sep. 19, 2012 and U.S. Provisional Application Ser. No. 61/675,938 filed Jul. 26, 2012. The U.S. Provisional Application Ser. No. 61/703,158 filed Sep. 19, 2012, U.S. Provisional Application Ser. No. 61/703,175 filed Sep. 19, 2012, U.S. Provisional Application Ser. No. 61/703,231 filed Sep. 19, 2012, U.S. Provisional Application Ser. No. 61/703,232, filed Sep. 19, 2012, U.S. Provisional Application Ser. No. 61/703,234, filed Sep. 19, 2012, U.S. Provisional Application Ser. No. 61/703,238 filed Sep. 19, 2012, U.S. Provisional Application Ser. No. 61/703,187 filed Sep. 19, 2012, U.S. Provisional Application Ser. No. 61/720,670 filed Oct. 31, 2012, U.S. Provisional Application Ser. No. 61/703,229 filed Sep. 19, 2012 and U.S. Provisional Application Ser. No. 61/675,938 filed Jul. 26, 2012 are hereby incorporated by reference in their entireties.

The U.S. patent application Ser. No. 13/724,885, filed Dec. 21, 2012 incorporates by reference U.S. patent application Ser. No. 13/724,988 filed on Dec. 21, 2012, now abandoned, U.S. patent application Ser. No. 13/724,339 filed on Dec. 21, 2012, now U.S. Pat. No. 9,175,407, U.S. patent application Ser. No. 13/724,878 filed on Dec. 21, 2012, now U.S. Pat. No. 8,647,493, U.S. patent application Ser. No. 13/724,647 filed on Dec. 21, 2012, now U.S. Pat. No. 8,845,876, U.S. patent application Ser. No. 13/724,231 filed on Dec. 21, 2012, now U.S. Pat. No. 8,845,875, U.S. patent application Ser. No. 13/724,807 filed on Dec. 21, 2012, now U.S. Pat. No. 8,692,019, U.S. patent application Ser. No. 13/724,996 filed on Dec. 21, 2012, now U.S. Pat. No. 8,691,069, U.S. patent application Ser. No. 13/724,719 filed on Dec. 21, 2012, now U.S. Pat. No. 9,303,324, U.S. patent application Ser. No. 13/724,082 filed on Dec. 21, 2012, now U.S. Pat. No. 8,021,709, and U.S. patent application Ser. No. 13/724,768 filed on Dec. 21, 2012, now U.S. Pat. No. 8,444,844 in their entireties.

FIELD

The present disclosure generally relates to the field of electrochemical reactions, and more particularly to methods and/or systems for electrochemical reduction of carbon dioxide using high surface area electrodes.

BACKGROUND

The combustion of fossil fuels in activities such as electricity generation, transportation, and manufacturing produces billions of tons of carbon dioxide annually. Research since the 1970s indicates increasing concentrations of carbon dioxide in the atmosphere may be responsible for altering the Earth's climate, changing the pH of the ocean and other potentially damaging effects. Countries around the world, including the United States, are seeking ways to mitigate emissions of carbon dioxide.

A mechanism for mitigating emissions is to convert carbon dioxide into economically valuable materials such as fuels and industrial chemicals. If the carbon dioxide is converted using energy from renewable sources, both mitigation of carbon dioxide emissions and conversion of renewable energy into a chemical form that can be stored for later use may be possible.

SUMMARY OF THE PREFERRED EMBODIMENTS

The present invention is directed to using high surface area electrodes and particular electrolyte solutions to produce single carbon (C1) chemicals, including formic acid, and multi-carbon (C2+) based chemicals (i.e., chemicals with two or more carbon atoms in the compound). The present invention includes the process, system, and various components thereof.

It is to be understood that both the foregoing general description and the following detailed description are exemplary and explanatory only and are not necessarily restrictive of the disclosure as claimed. The accompanying drawings, which are incorporated in and constitute a part of the specification, illustrate an embodiment of the disclosure and together with the general description, serve to explain the principles of the disclosure.

BRIEF DESCRIPTION OF THE DRAWINGS

The numerous advantages of the present disclosure may be better understood by those skilled in the art by reference to the accompanying figures in which.

DETAILED DESCRIPTION OF THE PREFERRED EMBODIMENTS

Reference will now be made in detail to the presently preferred embodiments of the present disclosure, examples of which are illustrated in the accompanying drawings.

In accordance with some embodiments of the present disclosure, an electrochemical system is provided that converts carbon dioxide to organic products including formate and formic acid. Use of a cathode comprising a high surface area three dimensional material, an acidic anolyte, and a catholyte comprising bicarbonate facilitates the process.

Before any embodiments of the invention are explained in detail, it is to be understood that the embodiments described below do not limit the scope of the claims that follow. Also, it is to be understood that the phraseology and terminology used herein is for the purpose of description and should not be regarded as limiting. The use of terms such as "including," "comprising," or "having" and variations thereof herein are generally meant to encompass the item listed thereafter and equivalents thereof as well as additional items. Further, unless otherwise noted, technical terms may be used according to conventional usage.

Figure 1:
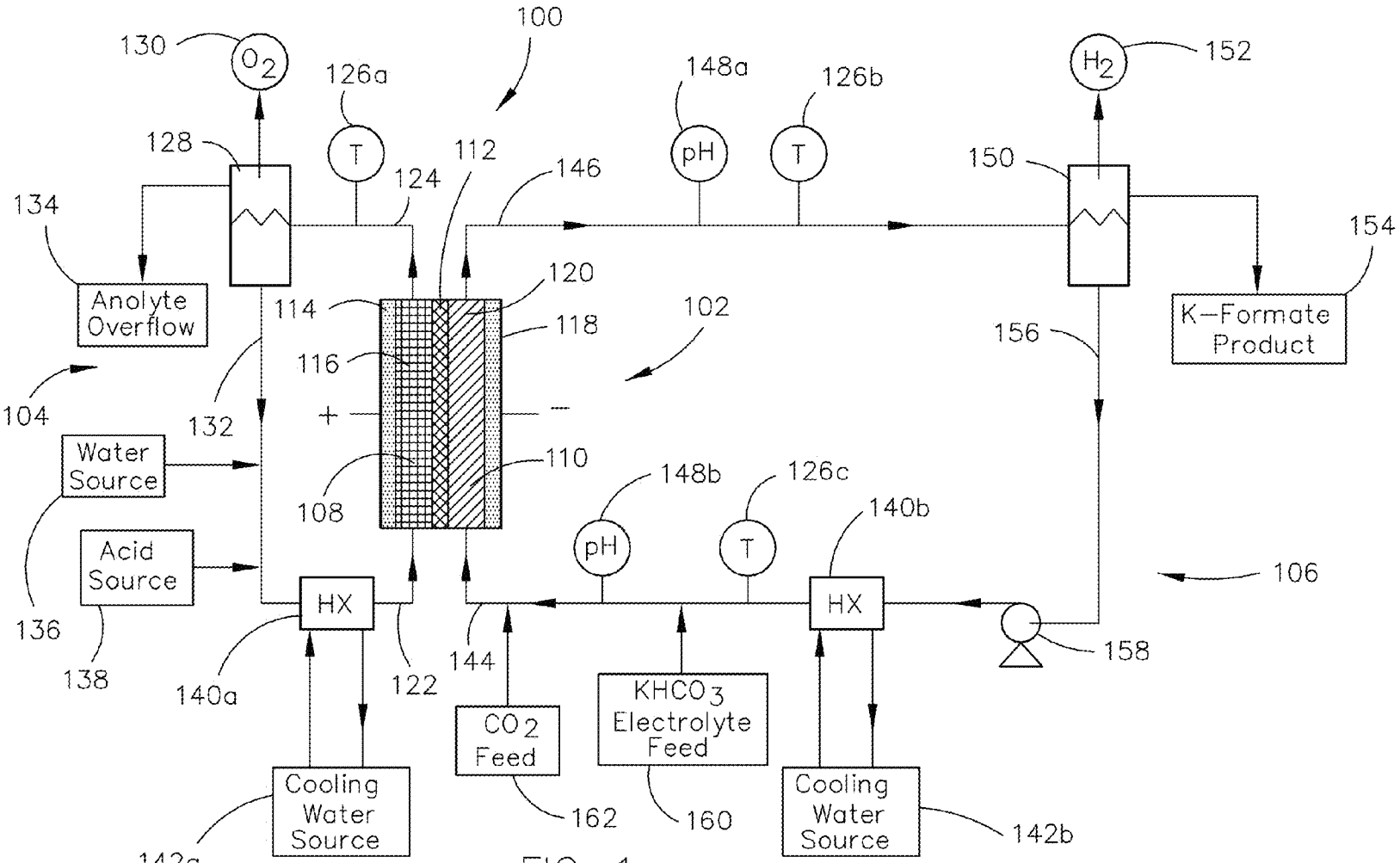
FIG. 1 is a flow diagram of a preferred electrolyzer system for the reduction of carbon dioxide in accordance with an embodiment of the present disclosure.

Referring to FIG. 1, a flow diagram of an electrolyzer system 100 is shown in accordance with an embodiment of the present invention. The electrolyzer system 100 may be utilized for the electrochemical reduction of carbon dioxide to organic products or organic product intermediates. Preferably, the electrolyzer system 100 reduces carbon dioxide to an alkali metal formate, such as potassium formate. The electrolyzer system 100 generally includes an electrolyzer 102, an anolyte recycle loop 104, and a catholyte recycle loop 106. The electrolyzer system 100 may include as process feeds/inputs carbon dioxide, a catholyte comprising bicarbonate (preferably potassium bicarbonate, but other bicarbonate-based compounds are contemplated instead of or in addition to potassium bicarbonate), and an acidic anolyte (preferably sulfuric acid, but may include other acids, instead of, or in addition to sulfuric acid). The product of the electrolyzer system 100 is generally an alkali metal formate, such as potassium formate, and may include excess catholyte, carbon dioxide, hydrogen, oxygen, and/or other unreacted process inputs.

The electrolyzer 102 generally includes an anode compartment 108 and a cathode compartment 110, and may further include a cation exchange membrane 112 to separate the anode compartment 108 from the cathode compartment 110. The anode compartment 108 includes an anode 114 suitable to oxidize water. In a preferred implementation, the anode 114 is a titanium anode having an anode electrocatalyst coating which faces the cation exchange membrane 112. For instance, the anode 114 may include an anode mesh screen 116 that includes a folded expanded titanium screen with an anode electrocatalyst coating. The anode mesh screen 116 may provide spacing and contact pressure between the anode 114 and the cation exchange membrane 112. The anode 114 may also include one or more electrical current connection posts (not shown) on a backside of the anode 114.

The cathode compartment 110 generally includes a cathode 118 mounted within the cathode compartment 110. The cathode 118 preferably includes a metal electrode with an active electrocatalyst layer on a front surface of the cathode 118 facing the cation exchange membrane 112, and may include one or more electrical current conduction posts (not shown) on a backside of the cathode 118. The cathode 118 preferably includes a high surface area cathode structure 120. The high surface area cathode structure 120 may be mounted between the cation exchange membrane 112 and the cathode 118 for conducting electrical current into the high surface area cathode structure 120. The interface between the high surface area cathode structure 120 and the cation exchange membrane 112 may include an insulator screen (not shown), such as a thin expanded plastic mesh insulator screen to minimize direct contact between the high surface area cathode structure 120 and the cation exchange membrane 112.

The anode compartment 108 generally includes an anode feed stream 122 that includes a dilute acid anolyte solution. The anode feed stream 122 may enter a bottom of the anode compartment 108 to flow by a face of the anode 114 and through the anode mesh screen 116. The reaction in the anode compartment 108 may include deriving oxygen ($O_2$, i.e., gaseous oxygen) and hydrogen ions ($H^+$) or protons from the oxidation of water at an applied current and voltage potential. The hydrogen ions or protons are generally available for the reactions within the cathode compartment 110 via the cation exchange membrane 112. The gaseous oxygen and other liquids leaving the anode compartment 108 of the electrolyzer 102 leave as anode exit stream 124. The anode exit stream 124 may be monitored by a temperature sensor 126*a* and may flow to an anolyte disengager 128 suitable for separating the oxygen from the anode exit stream 124. The anolyte disengager 128 may process the anode exit stream 124 into an oxygen stream 130, an anolyte recycle stream 132, and an anolyte overflow stream 134. The oxygen stream 130 may be vented from the anolyte disengager 128. The anolyte stream 132 may be combined with water (preferably deionized water) from a water source 136 and with acid (preferably sulfuric acid) from an acid source 138. The water source 136 and the acid source 138 in the anolyte recycle loop 104 may maintain anolyte acid strength and volume for the anode feed stream 122. The temperature of the anode feed stream 122 may be regulated by a heat exchanger 140*a* coupled with a cooling water source 142*a* prior to entering the anode compartment 108 of the electrolyzer 102.

The cathode compartment 110 generally includes a cathode feed stream 144 that includes carbon dioxide and a catholyte. In a preferred implementation, the catholyte is a bicarbonate compound, such as potassium bicarbonate ($KHCO_3$), which is saturated with carbon dioxide. The cathode feed stream 144 may enter a bottom of the cathode compartment 110 to flow by a face of the cathode 118 and through the high surface area cathode structure 120. The reaction in the cathode compartment 110 may reduce carbon dioxide to formate at an applied current and voltage potential. The reaction products and any unreacted materials (e.g., excess catholyte solution) may exit the cathode compartment 110 as cathode exit stream 146. The cathode exit stream 146 may be monitored by a pH sensor 148*a* and a temperature sensor 126*b* and may flow to a catholyte disengager 150 suitable for separating gaseous components (e.g., hydrogen) from the cathode exit stream 146. The catholyte disengager 150 may process the cathode exit stream 146 into a hydrogen stream 152, a product stream 154, and a catholyte recycle stream 156. The hydrogen stream 152 may be vented from the catholyte disengager 150. The product stream 154 preferably includes an alkali metal formate (such as potassium formate where the electrolyte includes potassium bicarbonate) and may include excess catholyte. The catholyte stream 156 may be processed by a catholyte recirculation pump 158 and a heat exchanger 140*b* coupled with a cooling water source 142*b*. A temperature sensor 126*c* may monitor the catholyte stream 156 downstream from the heat exchanger 140*b* having cooling water source 142*b*. A fresh catholyte electrolyte feed 160 may be metered into the catholyte stream 156, where the fresh catholyte electrolyte feed 160 may adjust the pH of the cathode feed stream 144 into the cathode compartment 110 of the electrolyzer 102, which may control final product overflow rate and establish the formate product concentration. The pH may be monitored by pH sensor 148*b*. A carbon dioxide stream 162 may be metered into the cathode feed stream 144 downstream from the catholyte electrolyte feed 160 prior to entering the cathode compartment 110 of the electrolyzer 102. Preferably, the carbon dioxide saturates the catholyte entering the cathode compartment.

When using an acidic anolyte, where protons are passed through the membrane into the cathode compartment, the pH of the electrolyzer 102 may be controlled or maintained through use of an alkali metal bicarbonate and/or carbonate in combination with water to control the pH of the catholyte. By controlling the pH of the catholyte at an optimum value, the cell may more efficiently convert carbon dioxide into C1 and C2 products with a higher conversion rate than if a non-optimum pH value was maintained or if no pH control mechanism was employed. In a preferred process, the catholyte is constantly recirculated to maintain an adequate and uniform carbon dioxide concentration at cathode surfaces coated with an electrocatalyst. A fresh catholyte feed stream may be used to control the pH of the catholyte and to control the product concentration in the product overflow stream. The mass flow rate of the catholyte feed to the cathode compartment (e.g., mass flow of potassium bicarbonate) is preferably balanced with the introduction of protons into the catholyte and with the formation of hydroxide from the inefficient byproduct reaction of water splitting at the cathode. The concentration of the potassium bicarbonate is important, since it provides volume to the catholyte, which will dilute the product in the catholyte.

For pH control of the catholyte, potassium bicarbonate is preferred, in a concentration range of 5 to 600 gm/L, or more preferably in the 10 to 500 gm/L range. If the feed concentration of bicarbonate to the catholyte is fixed, a separate feed of water may be employed into the catholyte to control final product concentration. In another implementation, potassium carbonate may be used as a feed for pH control. Potassium carbonate has a much higher solubility in water than potassium bicarbonate, and is preferably used in a concentration range of 5 to 1,500 gm/L.

Figure 2:
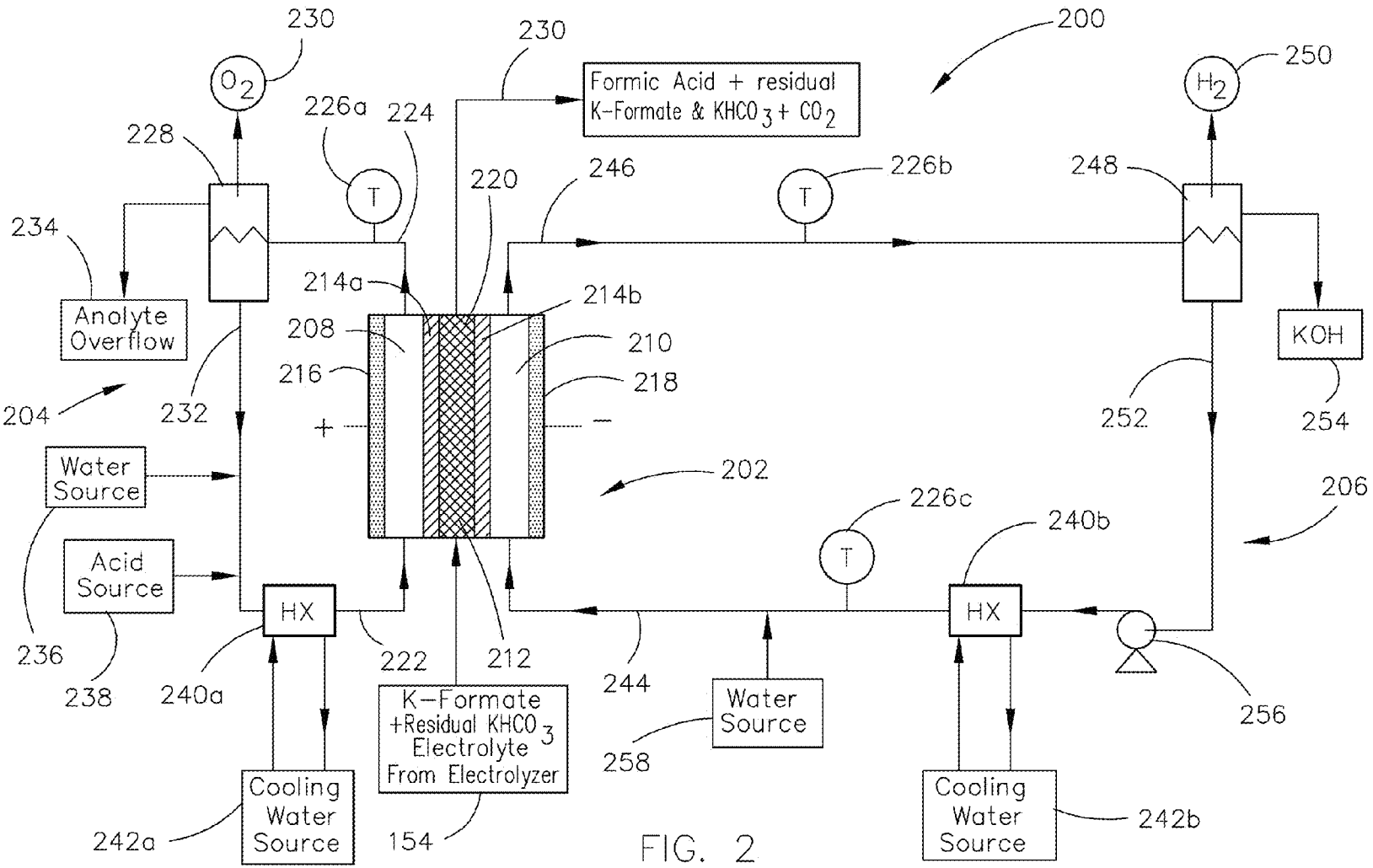
FIG. 2 is a flow diagram of a preferred electrochemical acidification system.

Referring now to FIG. 2, a block diagram of an electrochemical acidification system 200 is shown in accordance with an embodiment of the present invention. The electrochemical acidification system 200 may be utilized to acidify the product stream 154 from the electrolyzer system 100. Preferably, the electrochemical acidification system 200 acidifies an alkali metal formate, such as potassium formate, to form an organic acid, such as formic acid, and co-produce an alkali metal hydroxide, such as potassium hydroxide. The electrochemical acidification system 200 generally includes an electrochemical acidification unit 202, an anolyte recycle loop 204, and a catholyte recycle loop 206. The electrochemical acidification system 200 may include as process feeds/inputs the product stream 154 from the electrolyzer system 100 (which preferably includes an alkali metal formate), water in each of the anolyte recycle loop 204 and the catholyte recycle loop 206, and an acidic anolyte (preferably sulfuric acid, but may include other acids, instead of, or in addition to sulfuric acid). The product of the electrochemical acidification system 200 is generally an organic acid, such as formic acid, and an alkali metal hydroxide, and may include residual alkali metal formate, bicarbonate catholyte, carbon dioxide, hydrogen, oxygen, and/or other unreacted process inputs.

The electrochemical acidification unit 202 is preferably a three-compartment electrochemical acidification unit or cell. The electrochemical acidification unit 202 generally includes an anode compartment 208, a cathode compartment 210, and a central ion exchange compartment 212 bounded by cation exchange membranes 214*a* and 214*b* on each side. The anode compartment 208 includes an anode 216 suitable to oxidize water. In a preferred implementation, the anode 216 is a titanium anode having an anode electrocatalyst coating which faces the cation exchange membrane 214*a*. The cathode compartment 210 includes a cathode 218 suitable to reduce water and to generate an alkali metal hydroxide. In a preferred implementation, hydrogen ions ($H^+$) or protons are generated in the anode compartment 208 when a potential and current are applied to the electrochemical acidification unit 202. The hydrogen ions ($H^+$) or protons pass through the cation exchange membrane 214*a* into the central ion exchange compartment 212. The product stream 154 from the electrolyzer system 100 is preferably introduced to the electrochemical acidification unit 202 via the central ion exchange compartment 212, where the hydrogen ions ($H^+$) or protons displace the alkali metal ions (e.g., potassium ions) in the product stream 154 to acidify the stream and produce a product stream 260 including an organic acid product, preferably formic acid. The displaced alkali metal ions may pass through the cation exchange membrane 214*b* to the cathode compartment 210 to combine with hydroxide ions ($OH^-$) formed from water reduction at the cathode 218 to form an alkali metal hydroxide, preferably potassium hydroxide.

The central ion exchange compartment 212 may include a plastic mesh spacer (not shown) to maintain the dimensional space in the central ion exchange compartment 212 between the cation exchange membranes 214*a* and 214*b*. In an embodiment, a cation ion exchange material 220 is included in the central ion exchange compartment 212 between the cation exchange membranes 214*a* and 214*b*. The cation ion exchange material 220 may include an ion exchange resin in the form of beads, fibers, and the like. It is contemplated that the cation ion exchange material 220 may increase electrolyte conductivity in the ion exchange compartment solution, and may reduce the potential effects of carbon dioxide gas on the cell voltage as bubbles are formed and pass through the central ion exchange compartment 212.

The anode compartment 208 generally includes an anode feed stream 222 that includes an acid anolyte solution (preferably a sulfuric acid solution). The gaseous oxygen and other liquids leaving the anode compartment 208 of the electrochemical acidification unit 202 leave as anode exit stream 224. The anode exit stream 224 may be monitored by a temperature sensor 226*a* and may flow to an anolyte disengager 228 suitable for separating the oxygen from the anode exit stream 224. The anolyte disengager 228 may process the anode exit stream 224 into an oxygen stream 230, an anolyte recycle stream 232, and an anolyte overflow stream 234. The oxygen stream 230 may be vented from the anolyte disengager 228. The anolyte stream 232 may be combined with water (preferably deionized water) from a water source 236 and with acid (preferably sulfuric acid) from an acid source 238. The water source 236 and the acid source 238 in the anolyte recycle loop 204 may maintain anolyte acid strength and volume for the anode feed stream 222. The temperature of the anode feed stream 222 may be regulated by a heat exchanger 240*a* coupled with a cooling water source 242*a* prior to entering the anode compartment 208 of the electrochemical acidification unit 202.

The cathode compartment 210 generally includes a catholyte feed stream 244 that includes water and may include an alkali metal hydroxide that circulates through the catholyte recycle loop 206. The reaction products, which may include the alkali metal hydroxide and hydrogen gas, may exit the cathode compartment 210 as cathode exit stream 246. The cathode exit stream 246 may be monitored by a temperature sensor 226*b* and may flow to a catholyte disengager 248 suitable for separating gaseous components (e.g., hydrogen) from the cathode exit stream 246. The catholyte disengager 248 may process the cathode exit stream 246 into a hydrogen stream 250, a catholyte stream 252, and a catholyte overflow stream 254, which may include KOH. The hydrogen stream 250 may be vented from the catholyte disengager 248. The catholyte stream 252 preferably includes an alkali metal hydroxide (such as potassium hydroxide where the product steam 154 includes potassium formate). The catholyte stream 252 may be processed by a catholyte recirculation pump 256 and a heat exchanger 240*b* coupled with a cooling water source 242*b*. A temperature sensor 226*c* may monitor the catholyte stream 252 downstream from the heat exchanger 240*b*. The catholyte stream 252 may be combined with water (preferably deionized water) from a water source 258, where the water may be metered to control the concentration of the alkali metal hydroxide in the catholyte feed stream 244 entering the cathode compartment 210.

Figure 3:
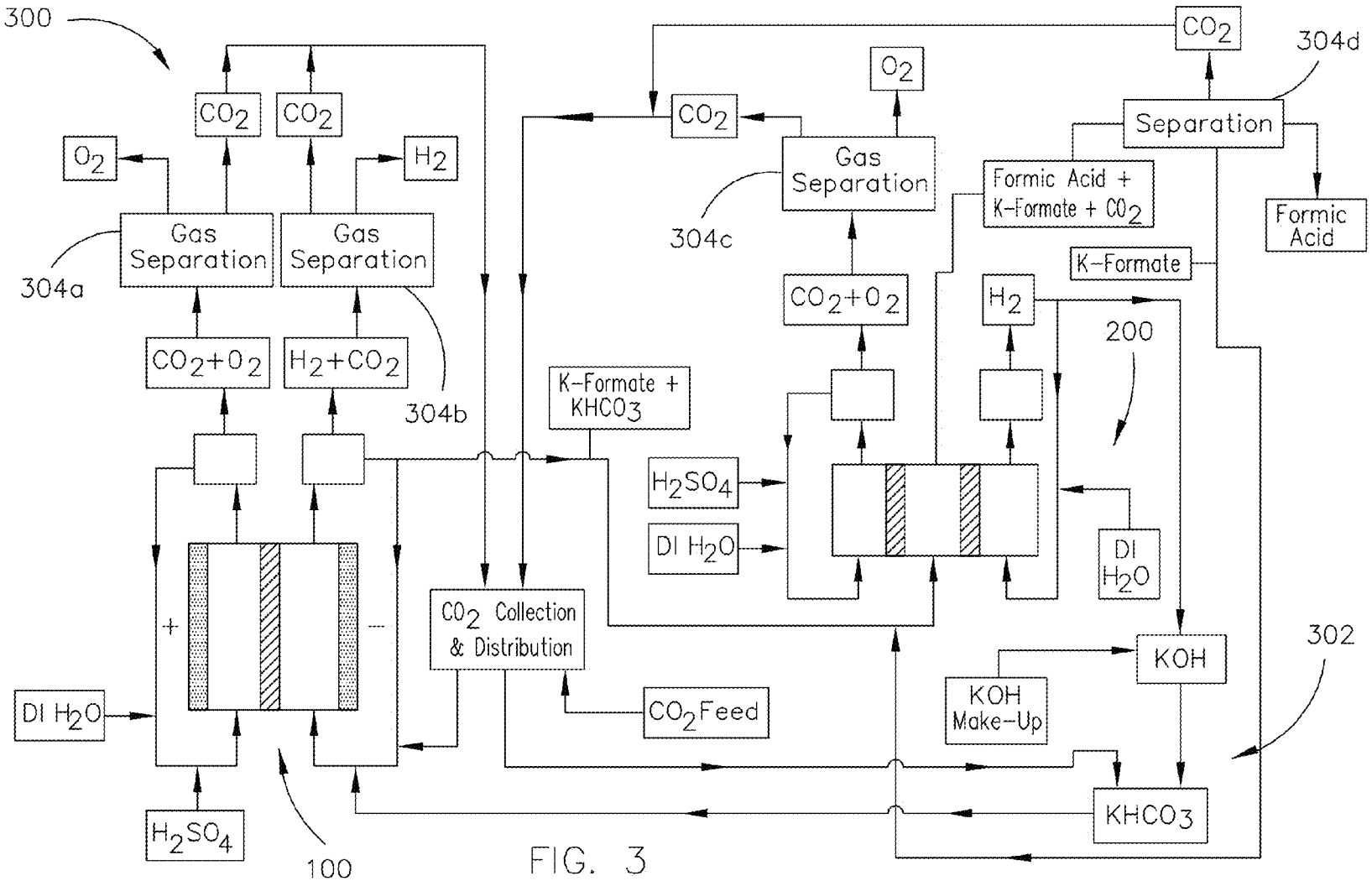
FIG. 3 is a flow diagram of another preferred system for the electrochemical reduction of carbon dioxide.

Referring now to FIG. 3, a flow diagram of a preferred system 300 for the electrochemical reduction of carbon dioxide to an organic acid product is shown. The system 300 may incorporate the electrolyzer system 100 (described with reference to FIG. 1) and the electrochemical acidification system 200 (described with reference to FIG. 2), and preferably includes a potassium hydroxide recycle loop 302 suitable for the production of potassium bicarbonate from potassium hydroxide and carbon dioxide. The system 300 may also incorporate carbon dioxide processing components for the separation (e.g., gas separation units 304*a*, 304*b*, 304*c*, 304*d*) and recovery of carbon dioxide from process streams.

The system 300 generally includes carbon dioxide, an alkali metal hydroxide (preferably potassium hydroxide), an acid (preferably sulfuric acid), and water (preferably deionized water) as process inputs and generally includes an organic acid (preferably formic acid), oxygen gas, and hydrogen gas as process outputs. The organic acid may undergo additional processing to provide a desired form and concentration. Such processing may include evaporation, distillation, or another suitable physical separation/concentration process.

The chemistry of the reduction of carbon dioxide in the system 300 may be as follows.

Hydrogen atoms are adsorbed at the electrode from the reduction of water as shown in equation (1).

$$H^+ + e^- \rightarrow H_{ad} \quad (1)$$

Carbon dioxide is reduced at the cathode surface with the adsorbed hydrogen atom to form formate, which is adsorbed on the surface as in equation (2).

$$CO_2 + H_{ad} \rightarrow HCOO_{ad} \quad (2)$$

The adsorbed formate on the surface then reacts with another adsorbed hydrogen atom to form formic acid that is then released into the solution as in equation (3)

$$HCOO_{ad} + H_{ad} \rightarrow HCOOH \quad (3)$$

The competing reaction at the cathode is the reduction of water where hydrogen gas is formed as well as hydroxide ions as in equation (4).

$$2H_2O + 2e^- H_2 + 2OH^- \quad (4)$$

The anode reaction is the oxidation of water into oxygen and hydrogen ions as shown in equation (5).

$$2H_2O \rightarrow 4H^+ + 4e^- + O_2 \quad (5)$$

High Surface Area Cathode

As described with reference to FIG. 1, the cathode 118 preferably includes a high surface area cathode structure 120. The high surface area cathode structure 120 preferably includes a void volume ranging from 30% to 98%. The specific surface area of the high surface area cathode structure 120 is preferably from 2 $cm^2/cm^3$ to 500 $cm^2/cm^3$ or higher. The surface area also can be defined as total area in comparison to the current distributor/conductor back plate, with a preferred range of 2× to 1000× or more.

The cathode 118 preferably includes electroless indium on tin (Sn) coated copper woven mesh, copper screen, copper fiber as well as bronze and other are copper-tin alloys, nickel and stainless steels. The metals may be precoated with other metals, such as to adequately form a suitable base for the application of the indium and other preferred cathode coatings. The cathode may also include Indium-Cu intermetallics formed on the surfaces of copper fiber, woven mesh, copper foam or copper screen. The intermetallics are generally harder than the soft indium metal, and may provide desirable mechanical properties in addition to usable catalytic properties. The cathode may also include, but is not limited to coatings and/or metal structures containing Pb, Sn, Hg, Tl, In, Bi, and Cd, their alloys, and combinations thereof. Metals including Ti, Nb, Cr, Mo, Ag, Cd, Hg, Tl, An, and Pb as well as Cr—Ni—Mo steel alloys among many others may be incorporated. The cathode 118 may include a single or multi-layered electrode coating, such that the electrocatalyst coating on the cathode substrate includes one or more layers of metals and alloys. A preferred electrocatalyst coating on the cathode includes a tin coating on a high surface area copper substrate with a top layer/coating of indium. The indium coating coverage preferably ranges from 5% to 100% as indium.

In the use of indium alloys on the exposed catalytic surfaces of the electrode, the indium composition preferably ranges from 5% to 99% as indium in alloys with other metals, including Sn, Pb, Hg, Tl, Bi, Cu, and Cd and their mixed alloys and combinations thereof. It is also contemplated to include Au, Ag, Zn, and Pd into the coating in percentages ranging from 1% to 95%.

Additionally, metal oxides may be used or prepared as electrocatalysts on the surfaces of the base cathode structure. For example, lead oxide can be prepared as an electrocatalyst on the surfaces of the base cathode structure. The metal oxide coating could be formed by a thermal oxidation method or by electro-deposition followed by chemical or thermal oxidation.

Additionally, the cathode base structure can also be gradated or graduated, such that the density of the cathode can be varied in the vertical or horizontal directions in terms of density, void volume, or specific surface area (e.g., varying fiber sizes). The cathode structure may also consist of two or more different electrocatalyst compositions that are either mixed or located in separate regions of the cathode structure in the catholyte compartment.

During normal operation of the electrolyzer 102, the performance of the system may decrease with regard to formate yield which may result from catalyst loss or overcoating of the catalyst with impurities, such as other metals that may be plated onto the cathode 118. The surfaces of the cathode 118 may be renewed by the periodic addition of indium salts or a mix of indium/tin salts in situ during operation of the electrolyzer 102. Depending on the composition of the cathode 118, it is contemplated that other or additional metal salts may be added in situ including salts of Ag, Au, Mo, Cd, Sn, and other suitable metals, singly or in combination. The electrolyzer 102 may be operated at full rate during operation, or temporarily operated at a lower current density with or without any carbon dioxide addition during the injection of the metal salts. The conditions under which to renew the cathode surface with the addition of these salts may differ depending on desired renewal results. The use of an occasional brief current reversal during electrochemical cell operation may also be employed to potentially renew the cathode surfaces.

In particular embodiments, the electrolyzer 102 is operated at pressures exceeding atmospheric pressure, which may result in higher current efficiency and permit operation of the electrolyzer 102 at higher current densities than when operating the electrolyzer 102 at or below atmospheric pressure.

In preparing cathode materials for the production of organic chemicals, the addition of metal salts that can reduce on the surfaces of the cathode structure can be also used, such as the addition of Ag, Au, Mo, Cd, Sn, and other suitable metals. Such addition of metal salts may provide a catalytic surface that may be otherwise difficult to prepare directly during cathode fabrication or for renewal of the catalytic surfaces.

A preferred method for preparing the high surface area cathode structure 120 is using an electroless plating solution which may include an indium salt, at least one complexing agent, a reducing agent, a pH modifier, and a surfactant. The preferred procedure for forming an electroless indium coating on the high surface area cathode may include combining in stirred deionized water the following materials: Trisodium citrate dihydrate (100 g/L), EDTA-disodium salt (15 g/L), sodium acetate (10 g/L), $InCl_3$ (anhydrous, 10 g/L), and Thiodiglycolic acid (0.3 g/L, e.g., 3 mL of 100 mg/mL solution). A pre-mixed stock deposition solution that has been stirred (preferably for multiple hours, e.g., overnight) may also be used. The procedure also includes heating the mixture to about 40° C. The procedure also includes adding 40 mL $TiCl_3$ (20 wt. % in 2% HCl) per liter [0.05 mM] and adding 7M ammonia in methanol until the pH of the mixture is approximately 7 (~15 mL ammonia solution per liter) at which point ammonium hydroxide (28% ammonia solution) is used to adjust the pH to between approximately 9.0 and 9.2. The procedure then includes heating the mixture to about 60° C. If the pH drops, adjust the pH to approximately 9.0 with ammonium hydroxide solution. The procedure then includes heating the mixture to about 75° C., where deposition may begin at about 65° C. The procedure includes holding the mixture at 75° C. for about one hour.

A preferred procedure for the metallic coating of copper substrates may include rinsing bare copper substrates in acetone to clean the copper surface (e.g., removing residual oils or grease that may be present on the copper surface) and then rinsing the acetone-treated copper substrates in deionized water. The procedure also includes immersing the bare copper substrates in a 10% sulfuric acid bath for approximately 5 minutes, and then rinsing with deionized water. The procedure also includes depositing approximately 25 μm of tin on the copper surface. The deposition may be done using a commercial electroless tinning bath (Caswell, Inc.) operated at 60° C. for 15 minutes. Following tin deposition, parts are rinsed thoroughly in deionized water. The procedure also includes depositing approximately 1 μm of indium on the tinned copper surface. The deposition may be done using an electroless bath operated at 90° C. for 60 minutes. Following indium deposition, parts are rinsed thoroughly in deionized water. The procedure may also include treated the copper/tin/indium electrode in a 5 wt % nitric acid bath for 5 minutes. Such treatment may improve electrode stability as compared to an untreated copper/tin/indium electrode. In another implementation, the electroless tin plated copper substrate may be dipped into molten indium for coating.

In particular implementations, cathode substrates may be treated with catalytic materials for carbon dioxide reduction. Four example treatments are presented by the following.

A first treatment may include coating a conductive substrate (e.g., vitreous carbon or metal) in a conductive sol-gel containing sufficient catalyst material to yield a high active surface area. The conductive component of the sol-gel may be catalytically active. After coating the substrate with the catalytic sol-gel, the sol-gel is allowed to undergo a high degree of polymerization/cross-linking. The combined substrate/sol-gel structure may then be pyrolized at high temperature to convert organic material to amorphous (and potentially conductive) carbon. The pyrolized structure may also be subjected to chemical treatments that selectively remove the organic material or the silica phase, leading to a high catalyst content coating.

The second treatment may include binding relatively small particles (e.g., micron or nanometer scale) to a substrate using a binding agent such as amines, thiols, or other suitable binding agent. The binding agent is preferably conductive to pass current between the substrate and catalyst particles. The catalyst particles preferably include conjugated organic molecules, such as diphenybenzene. If the substrate is also made of catalyst material the binding agent may have symmetrical binding groups, otherwise binding agents with two different binding groups may be utilized.

The third treatment may include coating a substrate in a slurry containing catalyst material (which may be in salt form) and a binding agent. The slurry may also contain a conductive additive, such as carbon black, carbon nanotubes, or other suitable conductive additive. The slurry coating may then be dried to form a conformal coating over the substrate. The substrate and dried slurry coating may be heated in order to fuse the various constituent materials into a mechanically robust, conductive, and catalytic material. In a particular implementation, the heating of the substrate and dried slurry coating occurs in a reducing environment.

The fourth treatment may include coating a substrate with semiconducting metal chalcogenides by applying a precursor to the substrate, removing solvent, and baking the substrate to convert the precursor material to a monolithic semiconducting metal chalcogenide coating. The coating materials may include, but are not limited to, $Na_4SnS_4$, $Na_4Sn_2S_6$, $K_4SnTe_4$, $Na_3AsS_3$, $(NH_4)_4Sn_2S_6$, $(NH_4)_3AsS_3$, and $(NH_4)_2MoS_4$.

Other coating and electrocatalyst preparation techniques include applying thermal oxides onto a substrate, forming an intermetallic with a substrate, and applying semiconductor materials on a substrate. In an embodiment, the thermal oxidation of various metal salts painted onto various metal and ceramic substrates is preferred for forming high surface area materials suitable for the electrochemical reduction of carbon dioxide. The thermal oxidation may be similar to that used for forming electrocatalysts on titanium for use as anode materials in electrochemical chlorine cells, such as iridium oxide and ruthenium oxide. In another embodiment, indium is electroplated onto a copper foil, then the copper foil is heated to 40° C. above the melting point of indium, until indium is melted on the foil surface, and forming a golden intermetallic with copper, and then cooled. The formation of the intermetallic can be done in air or under an inert gas atmosphere (e.g., argon or helium) or under a full or partial vacuum. The electroplated material preferably provides approximately 50% Faradaic conversion efficiency, and may be utilized as a coating on planar metal back plates and also on copper fibers. An intermetallic may also be formed with tin-plated copper substrates. In a further embodiment, a semiconductor material may be applied to a substrate by gaseous deposition, sputtering, or other suitable application methods. The substrate is preferably a metallic substrate. The semiconductor materials may be doped to P-type or N-type as desired.

In the four treatments and other coating techniques described above, certain measures may be taken to improve the quality (mechanical, electrical, etc.) of the bond between the substrate and catalyst. Such measures may involve creating functional groups on the substrate surface that can undergo chemical bonding with the catalyst or a binding agent, or the creation of geometrical features in the substrate surface that facilitate bonding with an applied catalyst coating.

The substrate for the high surface area cathodes described herein may include RVC materials, such as carbon and graphite, metal foams, woven metals, metal wools made from fibers, sintered powder metal films and plates, metal and ceramic beads, pellets, ceramic and metal column and trickle bed packing materials, metal and inorganic powder forms, metal fibers and wools, or other suitable substrate materials. The specific surface area of the physical forms preferably include a specific surface area between approximately 2 and 2,000 $cm^2/cm^3$ or greater.

The electrode or high surface area structure of an electrode may incorporate alloys as fibers or wools, and may be coated with various compounds, and subsequently fired in air or in a reducing atmosphere oven, to form stable oxides on the surfaces which are electrocatalytic in the reduction of carbon dioxide. Other cathode materials may include metallic glasses and amorphous metals.

Figure 4:
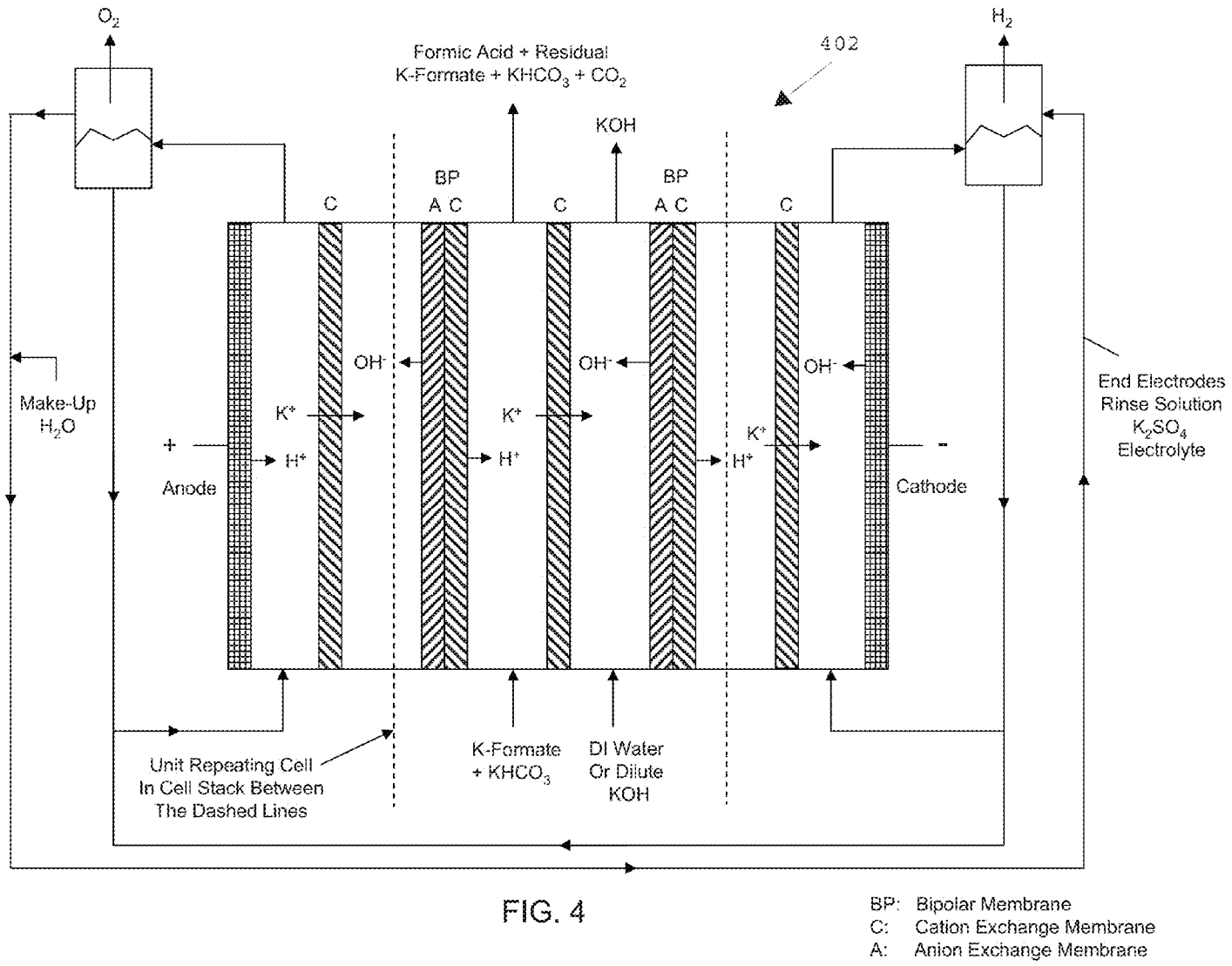
FIG. 4 is a flow diagram of another preferred electrochemical acidification system incorporating bipolar membranes.

Referring now to FIG. 4, a particular implementation of the acid acidification system 200 of FIG. 2 is shown utilizing bipolar membranes in an electrochemical acidification unit 402. By utilizing bipolar membranes in electrochemical acidification unit 402, the alkali metal formate (e.g., potassium formate) may be acidified in addition to recovering potassium hydroxide. The use of the bipolar membranes may reduce the voltage required for the acidification of the alkali metal formate and may reduce the number of actual anodes and cathodes needed for the electrochemical stack. The bipolar membranes preferably consist of a cation membrane and an anion membrane that have been bonded together, and function by splitting water at the two membrane interface, forming hydrogen ($H^+$) ions from the cation membrane and hydroxide ions ($OH^-$) from the anion membrane.

Figure 5:
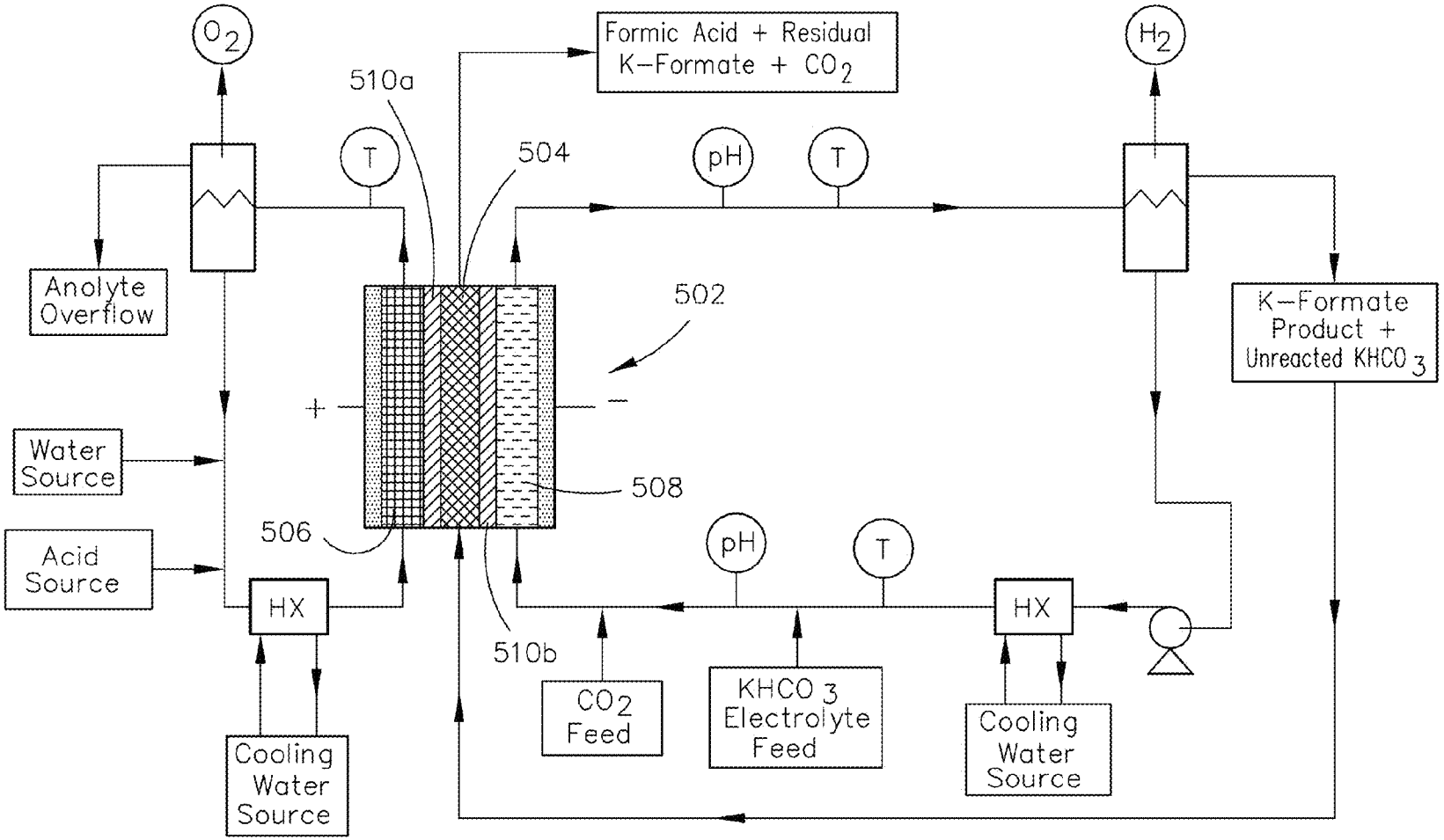
FIG. 5 is flow diagram of another preferred electrochemical electrolyzer system incorporating an ion exchange compartment for the reduction of carbon dioxide.

Referring now to FIG. 5, an alternative embodiment of the electrochemical system 100 of FIG. 1 is shown. The electrolyzer 502 in FIG. 5 includes an ion exchange compartment 504 in addition to an anode 506 compartment and a cathode compartment 508. This ion exchange compartment 504 functions similarly as the acid acidification compartment 212 in electrochemical acidification unit 202 as shown in FIG. 2. The alkali metal formate product (e.g., potassium formate) and unreacted $KHCO_3$ from the cathode compartment is passed through the ion exchange compartment 504 to provide a formic acid product with $CO_2$ and some residual $KHCO_3$. The hydrogen ions ($H^+$) passing through the adjacent membrane 510*a* on the anode compartment side displace the alkali metal ions (e.g., $K^+$) in the stream passing through the central ion exchange compartment 504 so that the alkali metal formate is acidified and the alkali metal ions and remaining hydrogen ions pass through the adjoining membrane 510*b* on the cathode compartment 508 and into the catholyte. This will allow operation of the catholyte at higher pH conditions if required for obtaining high Faradaic current efficiencies with the cathodes selected for the process.

In an indium-based cathode system, the preferred catholytes include alkali metal bicarbonates, carbonates, sulfates, phosphates, and the like. Other preferred catholytes include borates, ammonium, and hydroxides. Other catholytes may include chlorides, bromides, and other organic and inorganic salts. Non-aqueous electrolytes, such as propylene carbonate, methanesulfonic acid, methanol, and other ionic conducting liquids may be used, which may be in an aqueous mixture, or as a non-aqueous mixture in the catholyte. The introduction of micro bubbles of carbon dioxide into the catholyte stream may improve carbon dioxide transfer to the cathode surfaces.

Figure 6:
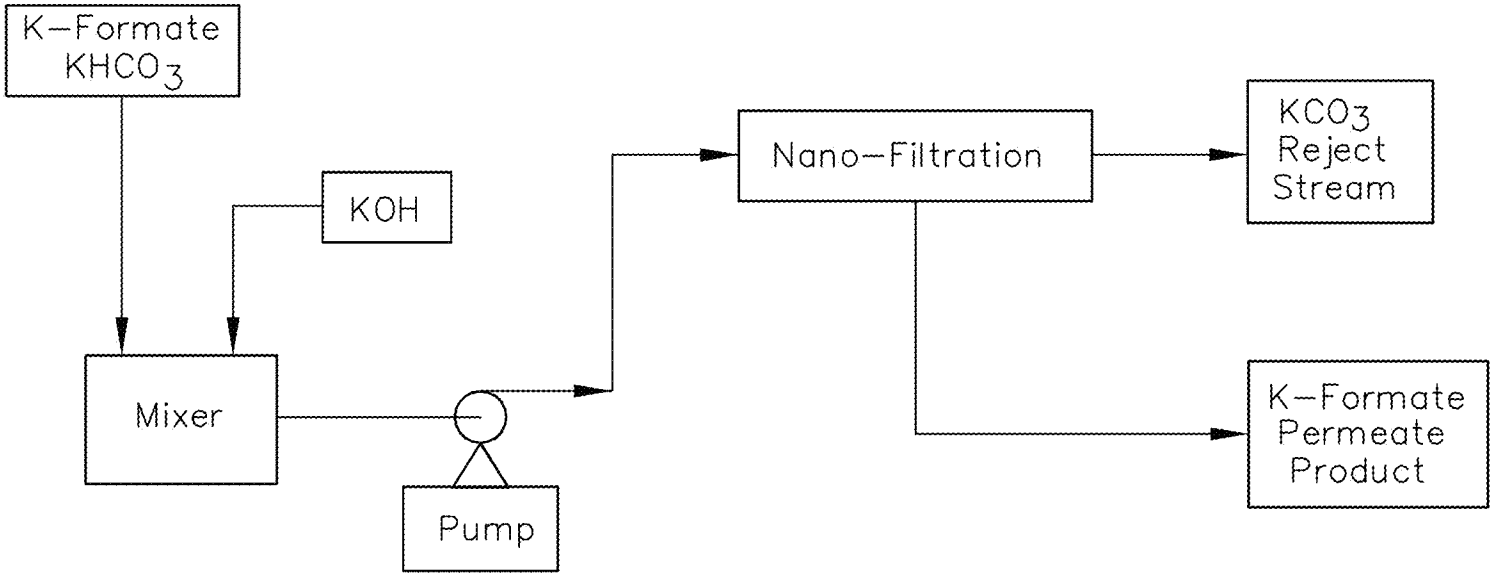
FIG. 6 is a flow diagram of a nano-filtration system in accordance with an embodiment of the present disclosure.

Referring now to FIG. 6, a nano-filtration system may be utilized between the electrolyzer system 100, as shown in FIG. 1, and the electrochemical acidification system 200, as shown in FIG. 2. The nano-filtration system is preferably utilized to separate alkali metal formate (e.g., potassium formate) from bicarbonate leaving the electrolyzer system 100 (e.g., stream 154) to reduce the amount of bicarbonate entering the electrochemical acidification unit 202. The nano-filtration system preferably uses a nano-filtration filter/membrane under pressure for selective separation of the bicarbonate from the alkali metal formate. The nano-filtration filter/membrane separates monovalent anions (e.g., formate) from divalent anions (e.g., carbonate) using a high pressure pump and suitable selected membranes for the separation. When utilizing the nano-filtration system as a separation tool between the electrolyzer system 100 and the electrochemical acidification system 200, the bicarbonate in the formate/bicarbonate product (e.g., stream 154) is preferably converted to carbonate in order to efficiently separate the formate from the carbonate with the nano-filtration filter/membrane. The nano-filtration system may include a mixer, such as a mixing tank, to mix the formate/bicarbonate product stream with a potassium hydroxide (KOH) stream. The mixer may promote the conversion of potassium bicarbonate to potassium carbonate to facilitate the separation of the formate from the carbonate. A high pressure pump then sends the potassium formate/carbonate stream into a nano-filtration unit which includes the nano-filtration filter/membrane. The nano-filtration unit produces a low-carbonate-containing potassium formate permeate stream which is then sent to the electrochemical acidification system 200 as shown in FIG. 2 as stream 154, to enter the electrochemical acidification unit 202. The potassium carbonate containing reject stream leaving the nano-filtration unit is preferably sent to the $KHCO_3$ block of FIG. 3, where the potassium carbonate is mixed with KOH and $CO_2$ for conversion to potassium bicarbonate. The potassium bicarbonate is preferably utilized as a feed to the cathode compartment of the electrolyzer 102 of the electrolyzer system 100. The nano-filtration separation system may consist of multiple units connected in a series flow configuration to increase the total separation efficiency of the carbonate from formate separation. The system may also utilize recycle streams to recycle an output stream from one unit to the input of another unit to maintain flow and pressures as well as to increase the recovery of the formate.

Depending on the chemistry of the electrochemical systems described herein, the pH of the catholyte preferably ranges from 3 to 12. The desired pH of the catholyte may be a function of the catholyte operating conditions and the catalysts used in the cathode compartment, such that there is limited or no corrosion at the electrochemical cell.

Preferable catholyte cross sectional area flow rates may include a range of 2 to 3,000 gpm/ft$^2$ or more (0.0076 to 11.36 m$^3$/m$^2$), with a flow velocity range of 0.002 to 20 ft/sec (0.0006 to 6.1 m/sec).

A homogenous heterocyclic catalyst is preferably utilized in the catholyte. The homogenous heterocyclic catalyst may include, for example, one or more of 4-hydroxy pyridine, adenine, a heterocyclic amine containing sulfur, a heterocyclic amine containing oxygen, an azole, a benzimidazole, a bipyridine, furan, an imidazole, an imidazole related species with at least one five-member ring, an indole, a lutidine, methylimidazole, an oxazole, phenanthroline, pterin, pteridine, a pyridine, a pyridine related species with at least one six-member ring, pyrrole, quinoline, or a thiazole, and mixtures thereof.

Preferred anolytes for the system include alkali metal hydroxides, such as KOH, NaOH, LiOH; ammonium hydroxide; inorganic acids such as sulfuric, phosphoric, and the like; organic acids such as methanesulfonic acid; non-aqueous and aqueous solutions; alkali halide salts, such as the chlorides, bromides, and iodine types such as NaCl, NaBr, LiBr, and NaI; and acid halides such as HCl, HBr and HI. The acid halides and alkali halide salts will produce for example chlorine, bromine, or iodine as a halide gas or as dissolved aqueous products from the anolyte compartment. Methanol or other hydrocarbon non-aqueous liquids can also be used, and would form some oxidized organic products from the anolyte. Selection of the anolyte would be determined by the process chemistry product and requirements for lowering the overall operating cell voltage. For example, the formation of bromine at the anode requires a significantly lower anode voltage potential than chlorine formation, and iodine is even lower than that of bromine. This allows for a significant power cost savings in the operation of both of the electrochemical units when bromine is generated in the anolyte. The formation of a halogen, such as bromine, in the anolyte may then be used in an external reaction to produce other compounds, such as reactions with alkanes to form bromoethane, which may then be converted to an alcohol, such as ethanol, or an alkene, such as ethylene, and the halogen acid byproduct from the reaction can be recycled back to the electrochemical cell anolyte.

Operation of the electrolyzer catholyte at a higher operating pressure may allow more carbon dioxide to dissolve in the aqueous electrolyte than at lower pressures (e.g., ambient pressures). Electrochemical cells may operate at pressures up to about 20 to 30 psig in multi-cell stack designs, although with modifications, they could operate at up to 100 psig. The electrolyzer anolyte may also be operated in the same pressure range to minimize the pressure differential on the membrane separating the two electrode compartments. Special electrochemical designs are required to operate electrochemical units at higher operating pressures up to about 60 to 100 atmospheres or greater, which is in the liquid $CO_2$ and supercritical $CO_2$ operating range.

In a particular implementation, a portion of the catholyte recycle stream may be separately pressurized using a flow restriction with backpressure or using a pump, with $CO_2$ injection, such that the pressurized stream is then injected into the catholyte compartment of the electrolyzer. Such a configuration may increase the amount of dissolved $CO_2$ in the aqueous solution to improve the conversion yield.

Catholyte and anolyte operating temperatures preferably range from −10 to 95° C., more preferably 5 to 60° C. The minimum operating temperature will be limited to the electrolytes used and their freezing points. In general, the lower the temperature, the higher the solubility of $CO_2$ in the aqueous solution phase of the electrolyte, and would help in obtaining higher conversion and current efficiencies. A consideration for lower operating temperatures is that the operating electrolyzer cell voltages may be higher, so an optimization may be required to produce the chemicals at the lowest operating cost.

The electrochemical cell design may include a zero gap, flow-through design with a recirculating catholyte electrolyte with various high surface area cathode materials. Other designs include: flooded co-current packed and trickle bed designs with the various high surface area cathode materials, bipolar stack cell designs, and high pressure cell designs.

Anodes for use in the electrochemical system may depend on various system conditions. For acidic anolytes and to oxidize water to generate oxygen and hydrogen ions, the anode may include a coating, with preferred electrocatalytic coatings including precious metal oxides, such as ruthenium and iridium oxides, as well as platinum, rhodium, and gold and their combinations as metals and oxides deposited on valve metal substrates, such as titanium, tantalum, zirconium, and niobium. For other anolytes, such as alkaline or hydroxide electrolytes, the anode made include carbon, cobalt oxides, stainless steels, nickel, and their alloys and combinations which may be stable as anodes suitable under alkaline conditions.

As described herein, the electrochemical system may employ a membrane positioned between the anode compartment and the cathode compartment. Cation ion exchange type membranes are preferred, especially those that have a high rejection efficiency to anions, for example perfluorinated sulfonic acid based ion exchange membranes such as DuPont Nafion® brand unreinforced types N117 and N120 series, more preferred PTFE fiber reinforced N324 and N424 types, and similar related membranes manufactured by Japanese companies under the supplier trade names such as Flemion®. Other multi-layer perfluorinated ion exchange membranes used in the chlor alkali industry have a bilayer construction of a sulfonic acid based membrane layer bonded to a carboxylic acid based membrane layer, which efficiently operates with an anolyte and catholyte above a pH of about 2 or higher. These membranes have a much higher anion rejection efficiency. These are sold by DuPont under their Nafion® trademark as the N900 series, such as the N90209, N966, N982, and the 2000 series, such as the N2010, N2020, and N2030 and all of their types and subtypes. Hydrocarbon based membranes, which are made from various cation ion exchange materials can also be used if the anion rejection is not as critical, such as those sold by Sybron under their trade name Ionac®, AGC Engineering (Asahi Glass) under their Selemion® trade name, and Tokuyama Soda, among others available on the market.

Example Electrolyzer Design

The electrolyzer design used in laboratory examples may incorporate various thickness high surface area cathode structures using added spacer frames and also provide the physical contact pressure for the electrical contact to the cathode current conductor backplate.

An electrochemical bench scale cell with an electrode projected area of about 108 $cm^2$ was used for much of the bench scale test examples. The electrochemical cell was constructed consisting of two electrode compartments machined from 1.0 inch (2.54 cm) thick natural polypropylene. The outside dimensions of the anode and cathode compartments were 8 inches (20.32 cm) by 5 inches (12.70 cm) with an internal machined recess of 0.375 inches (0.9525 cm) deep and 3.0 inches (7.62 cm) wide by 6 inches (15.24 cm) tall with a flat gasket sealing area face being 1.0 inches (2.52 cm) wide. Two holes were drilled equispaced in the recess area to accept two electrode conductor posts that pass though the compartment thickness, and having two 0.25 inch (0.635 cm) drilled and tapped holes to accept a plastic fitting that passes through 0.25 inch (0.635 cm) conductor posts and seals around it to not allow liquids from the electrode compartment to escape to the outside. The electrode frames were drilled with an upper and lower flow distribution hole with 0.25 inch pipe threaded holes with plastic fittings installed to the outside of the cell frames at the top and bottom of the cells to provide flow into and out of the cell frame, and twelve 0.125 inch (0.3175 cm) holes were drilled through a 45 degree bevel at the edge of the recess area to the upper and lower flow distribution holes to provide an equal flow distribution across the surface of the flat electrodes and through the thickness of the high surface area electrodes of the compartments.

For the anode compartment cell frames, an anode with a thickness of 0.060 inch (0.1524 cm) and 2.875 inch (7.3025 cm) width and 5.875 inch (14.9225 cm) length with two 0.25 inch (0.635 cm) titanium diameter conductor posts welded on the backside were fitted through the two holes drilled in the electrode compartment recess area. The positioning depth of the anode in the recess depth was adjusted by adding plastic spacers behind the anode, and the edges of the anode to the cell frame recess were sealed using a medical grade epoxy. The electrocatalyst coating on the anode was a Water Star WS-32, an iridium oxide based coating on a 0.060 inch (0.1524 cm) thick titanium substrate, suitable for oxygen evolution in acids. In addition, the anode compartment also employed an anode folded screen (folded three times) that was placed between the anode and the membrane, which was a 0.010 inch (0.0254 cm) thick titanium expanded metal material from DeNora North America (EC626), with an iridium oxide based oxygen evolution coating, and used to provide a zero gap anode configuration (anode in contact with membrane), and to provide pressure against the membrane from the anode side which also had contact pressure from the cathode side.

For the cathode compartment cell frames, 316L stainless steel cathodes with a thickness of 0.080 inch (0.2032 cm) and 2.875 inch (7.3025 cm) width and 5.875 inch (14.9225 cm) length with two 0.25 inch (0.635 cm) diameter 316L SS conductor posts welded on the backside were fitted through the two holes drilled in the electrode compartment recess area. The positioning depth of the cathode in the recess depth was adjusted by adding plastic spacers behind the cathode, and the edges of the cathode to the cell frame recess were sealed using a fast cure medical grade epoxy.

A copper bar was connected between the two anode posts and the cathode posts to distribute the current to the electrode back plate. The cell was assembled and compressed using 0.25 inch (0.635 cm) bolts and nuts with a compression force of about 60 in-lbs force. Neoprene elastomer gaskets (0.0625 inch (0.159 cm) thick) were used as the sealing gaskets between the cell frames, frame spacers, and the membranes.

Example 1

The above cell was assembled with a 0.010 inch (0.0254 cm) thickness indium foil mounted on the 316L SS back conductor plate using a conductive silver epoxy. A multi-layered high surface area cathode, comprising an electrolessly applied indium layer of about 1 micron thickness that was deposited on a previously applied layer of electroless tin with a thickness of about 25 micron thickness onto a woven copper fiber substrate. The base copper fiber structure was a copper woven mesh obtained from an on-line internet supplier, PestMall.com (Anteater Pest Control Inc.). The copper fiber dimensions in the woven mesh had a thickness of 0.0025 inches (0.00635 cm) and width of 0.010 inches (0.0254 cm). The prepared high surface area cathode material was folded into a pad that was 1.25 inches (3.175 cm) thick and 6 inches (15.24 cm) high and 3 inches (7.62 cm) wide, which filled the cathode compartment dimensions and exceeded the adjusted compartment thickness (adding spacer) which was 0.875 inches (2.225 cm) by about 0.25 inches (0.635 cm). The prepared cathode had a calculated surface area of about 3,171 $cm^2$, for an area about 31 times the flat cathode plate area, with a 91% void volume, and specific surface area of 12.3 $cm^2/cm^3$. The cathode pad was compressible, and provided the spring force to make contact with the cathode plate and the membrane. Two layers of a very thin (0.002 inches thick) plastic screen with large 0.125 inch (0.3175 cm) holes were installed between the cathode mesh and the Nafion® 324 membrane. Neoprene gaskets (0.0625 inch (0.159 cm) thick) were used as the sealing gaskets between the cell frames and the membranes. The electrocatalyst coating on the anode in the anolyte compartment was a Water Star WS-32, an iridium oxide based coating, suitable for oxygen evolution in acids. In addition, the anode compartment also employed a three-folded screen that was placed between the anode and the membrane, which was a 0.010 inch (0.0254 cm) thick titanium expanded metal material from DeNora North America (EC626), with an iridium oxide based oxygen evolution coating, and used to provide a zero gap anode configuration (anode in contact with membrane), and to provide pressure against the membrane from the anode side which also had contact pressure from the cathode side.

The cell assembly was tightened down with stainless steel bolts, and mounted into the cell station, which has the same configuration as shown in FIG. 1 with a catholyte disengager, a centrifugal catholyte circulation pump, inlet cell pH and outlet cell pH sensors, a temperature sensor on the outlet solution stream. A 5 micron stainless steel frit filter was used to sparge carbon dioxide into the solution into the catholyte disengager volume to provide dissolved carbon dioxide into the recirculation stream back to the catholyte cell inlet.

The anolyte used was a dilute 5% by volume sulfuric acid solution, made from reagent grade 98% sulfuric acid and deionized water.

In this test run, the system was operated with a catholyte composition containing 0.4 molar potassium sulfate aqueous with 2 gm/L of potassium bicarbonate added, which was sparged with carbon dioxide to an ending pH of 6.60.

Operating Conditions:
Batch Catholyte Recirculation Run
Anolyte Solution: 0.92 M $H_2SO_4$
Catholyte Solution: 0.4 M $K_2SO_4$, 0.14 mM $KHCO_3$
Catholyte flow rate: 2.5 LPM
Catholyte flow velocity: 0.08 ft/sec
Applied cell current: 6 amps (6,000 mA)
Catholyte pH range: 5.5-6.6, controlled by periodic additions of potassium bicarbonate to the catholyte solution recirculation loop. Catholyte pH declines with time, and is controlled by the addition of potassium bicarbonate.

Figure 7:
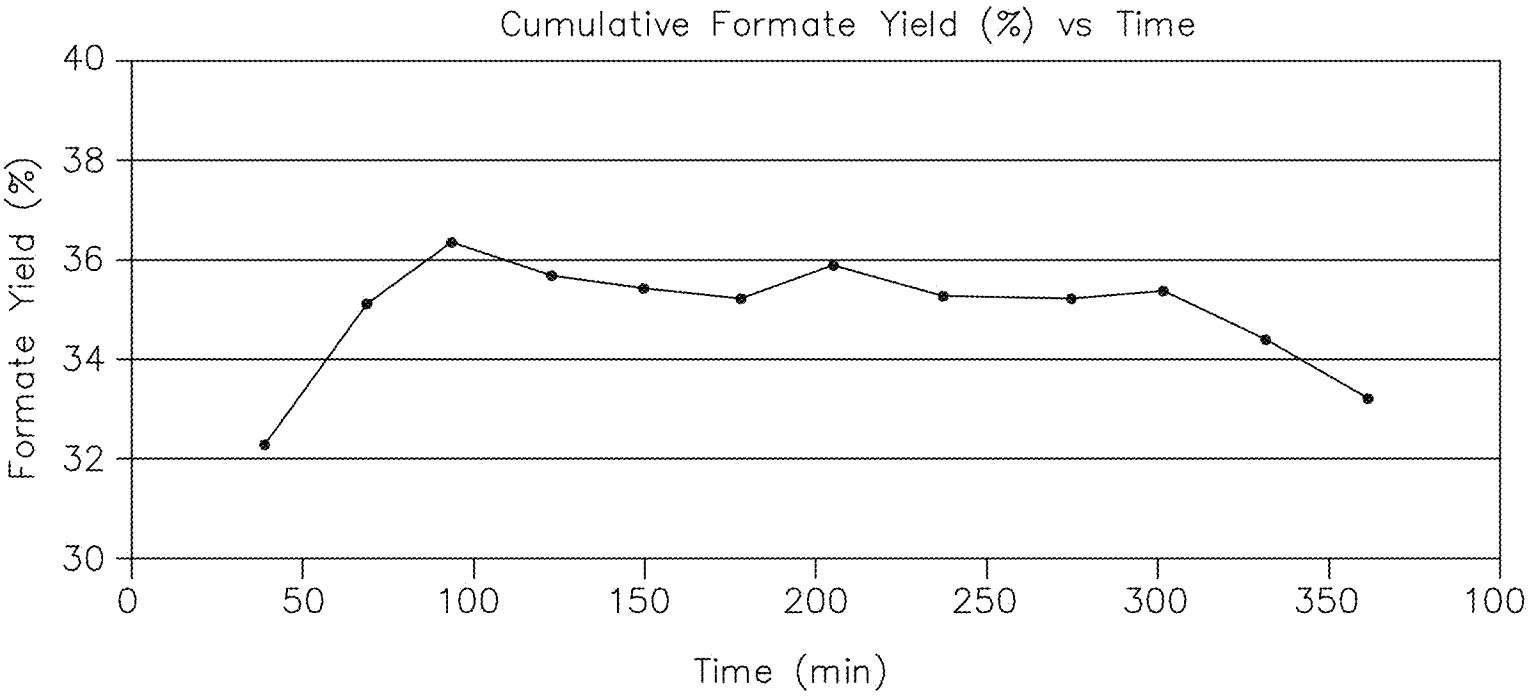
FIG. 7 is a chart illustrating cumulative yield of formate over time in accordance with an embodiment described with reference to Example 1 of the present disclosure.

Results:
Cell voltage range: 3.39-3.55 volts (slightly lower voltage when the catholyte pH drops)
Run time: 6 hours
Formate Faradaic yield: Steady between 32-35%, calculated taking samples periodically. See FIG. 7.
Final formate concentration: 9,845 ppm

Example 2

The same cell as in Example 1 was used with the same cathode, which was only rinsed with water while in the electrochemical cell after the run was completed and then used for this run.

In this test run, the system was operated with a catholyte composition containing 0.375 molar potassium sulfate aqueous with 40 gm/L of potassium bicarbonate added, which was sparged with carbon dioxide to an ending pH of 7.05.

Operating Conditions:
Batch Catholyte Recirculation Run
Anolyte Solution: 0.92 M $H_2SO_4$
Catholyte Solution: 0.4 M $K_2SO_4$, 0.4 M $KHCO_3$
Catholyte flow rate: 2.5 LPM
Catholyte flow velocity: 0.08 ft/sec
Applied cell current: 6 amps (6,000 mA)
Catholyte pH range: Dropping from 7.5 to 6.75 linearly with time during the run.

Figure 8:
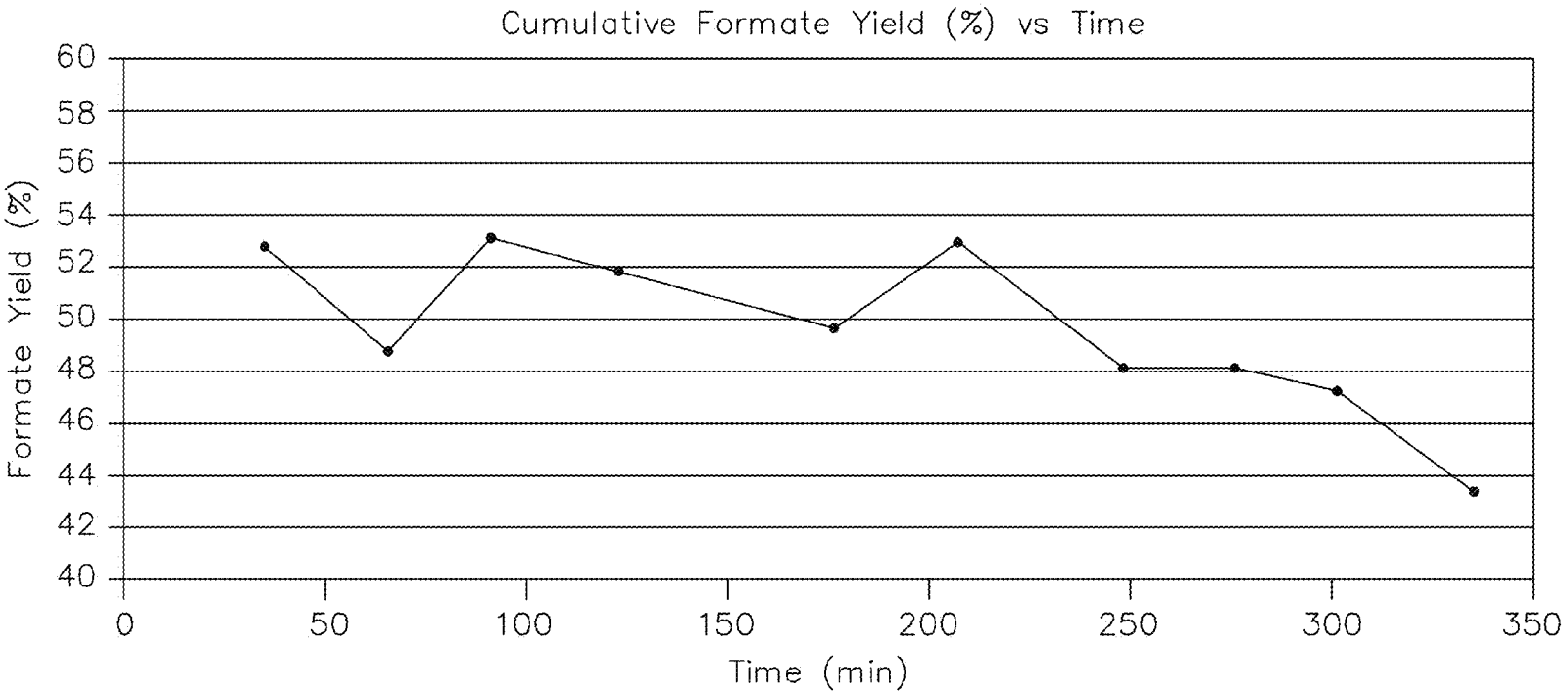
FIG. 8 is a chart illustrating cumulative yield of formate over time in accordance with an embodiment described with reference to Example 2 of the present disclosure.

Results:
Cell voltage range: 3.40-3.45 volts
Run time: 5.5 hours
Formate Faradaic yield: Steady at 52% and slowly declining with time to 44% as the catholyte pH dropped. See FIG. 8.
Final formate concentration: 13,078 ppm

Example 3

The same cell as in Examples 1 and 2 was used with the same cathode, which was only rinsed with water while in the electrochemical cell after the run was completed and then used for this run.

In this test run, the system was operated with a catholyte composition containing 0.200 molar potassium sulfate aqueous with 40 gm/L of potassium bicarbonate added, which was sparged with carbon dioxide to an ending pH of 7.10.

Operating Conditions:
Batch Catholyte Recirculation Run
Anolyte Solution: 0.92 M $H_2SO_4$
Catholyte Solution: 0.2 M $K_2SO_4$, 0.4 M $KHCO_3$
Catholyte flow rate: 2.5 LPM
Catholyte flow velocity: 0.08 ft/sec
Applied cell current: 9 amps (9,000 mA)
Catholyte pH range: Dropping from 7.5 to 6.65 linearly with time during the run, and then additional solid $KHCO_3$ was added to the catholyte loop in 10 gm increments at the 210, 252, and 290 minute time marks which brought the pH back up to about a pH of 7 for the last part of the run.

Figure 9:
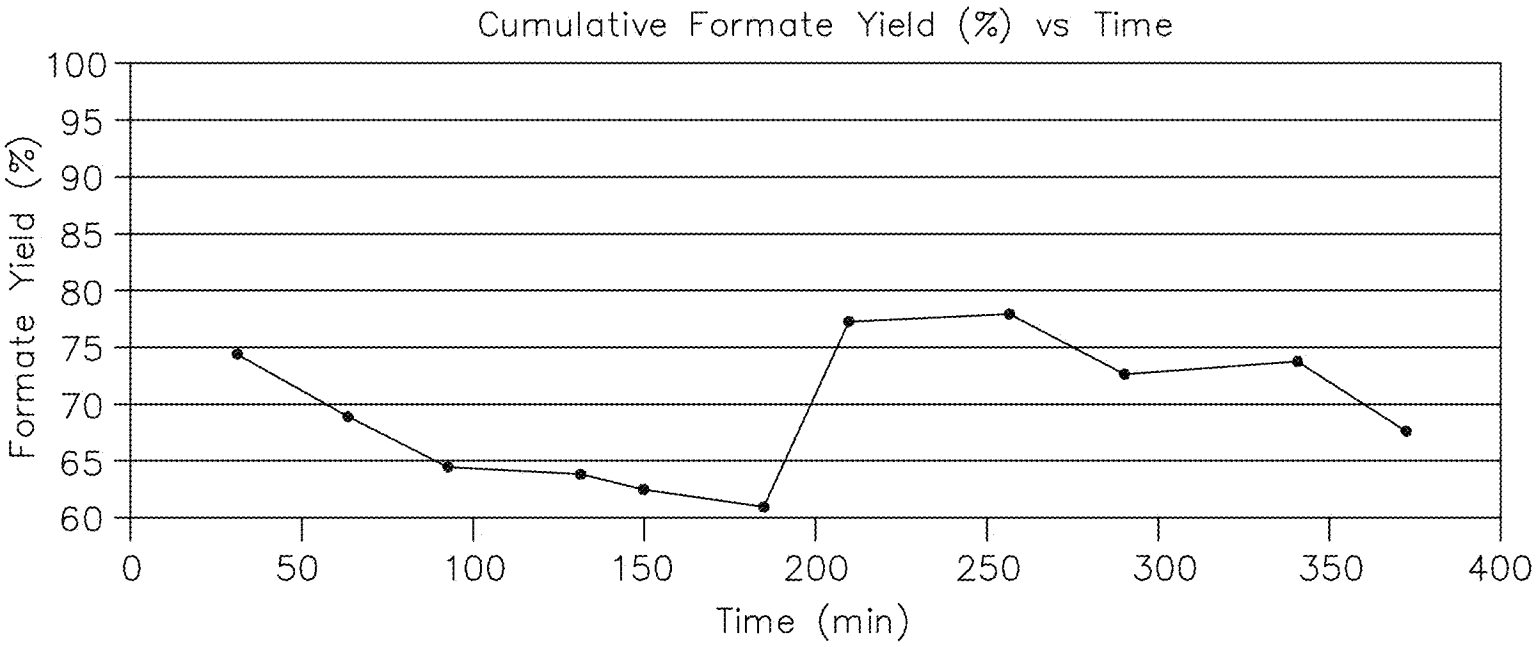
FIG. 9 is a chart illustrating cumulative yield of formate over time in accordance with an embodiment described with reference to Example 3 of the present disclosure.

Results:
Cell voltage range: 3.98-3.80 volts
Run time: 6.2 hours
Formate Faradaic yield: 75% declining to 60% at a pH of 6.65, and then increasing to 75% upon the addition of solid potassium bicarbonate to the catholyte to the catholyte loop in 10 gm increments at the 210, 252, and 290 minute time marks and slowly declining down with time 68% as the catholyte pH dropped to 6.90. See FIG. 9.
Final formate concentration: 31,809 ppm.

Example 4

The same cell as in Examples 1, 2, and 3 was used with the same cathode, which was only rinsed with water while in the electrochemical cell after the run was completed and then used for this run.

In this test run, the system was operated with a catholyte composition containing 1.40 molar potassium bicarbonate (120 gm/L $KHCO_3$), which was sparged with carbon dioxide to an ending pH of 7.8.

Operating Conditions:
Batch Catholyte Recirculation Run
Anolyte Solution: 0.92 M $H_2SO_4$
Catholyte Solution: 1.4 M $KHCO_3$
Catholyte flow rate: 2.6 LPM
Catholyte flow velocity: 0.09 ft/sec
Applied cell current: 11 amps (11,000 mA)

Catholyte pH range: Dropping from around 7.8 linearly with time during the run to a final pH of 7.48

Results:

Cell voltage range: 3.98-3.82 volts

Run time: 6 hours

Formate Faradaic yield: 63% and settling down to about 54-55%. See FIG. 10.

Final formate concentration: 29,987 ppm.

Prophetic Example 5

Figure 10:
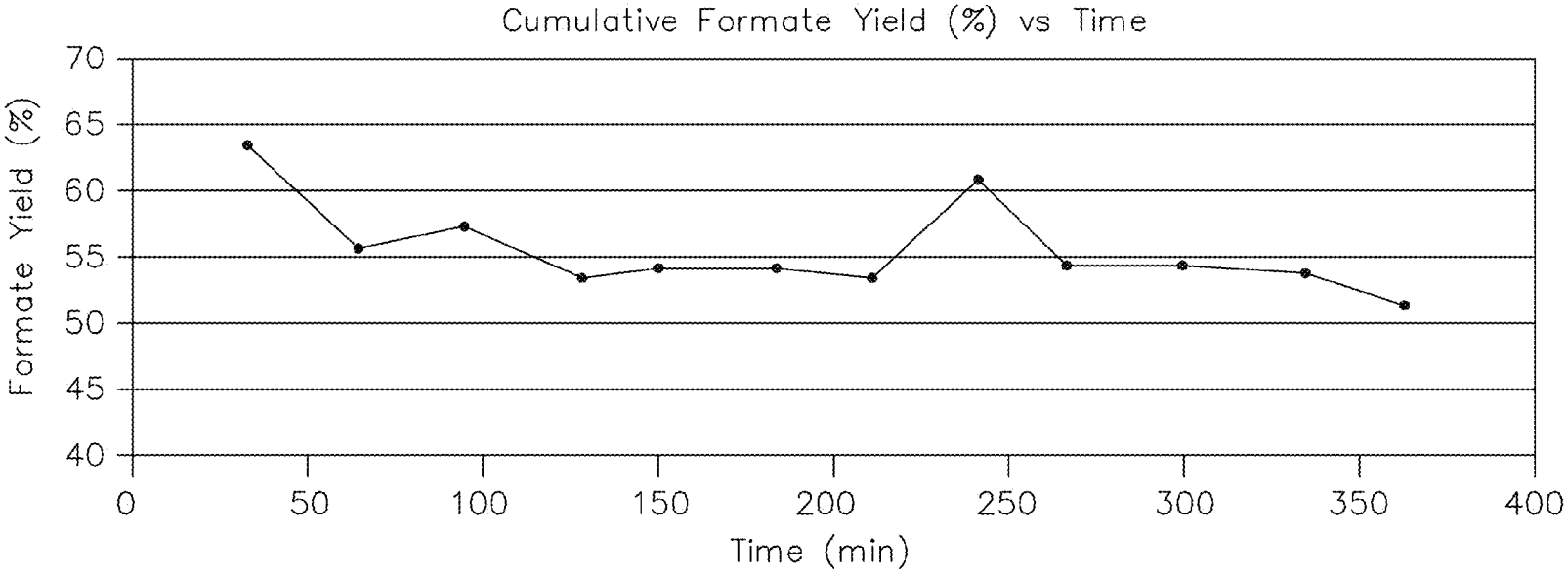
FIG. 10 is a chart illustrating cumulative yield of formate over time in accordance with an embodiment described with reference to Example 4 of the present disclosure.

This example contemplates separation of product potassium formate from potassium carbonate/bicarbonate supporting electrolyte by membrane nano-filtration (NF) (FIG. 10). The test would involve two commercial NF membranes. The feed solution would comprise 1.2M $KHCO_3$+0.6M K-m formate and its pH would be adjusted to 7, 9, and 11 for three separate runs (for each membrane).

All NF tests would be performed in GE-Osmonic Sepa permeator (active membrane area of 0.0137 $m^2$) at applied pressure of 40 bar (580 psig) and 50° C. During each run 3 liters of feed solution would be passed through and the permeate would be collected into a measuring cylinder (to determine volume) and the elapsed time recorded. The permeate would later be analyzed for total carbonate ($HCO_3^-$+$CO_3^{2-}$) and formate. From such data, the permeability (in L/$m^2$ h bar) and solute rejections (in %) would be calculated as follows:

$$\text{Permeability} = \frac{\text{volume collected } (L)}{\text{membrane area } (m2) \times \text{elapsed time}(h)}$$

$$\%\ \text{Rejection} = \frac{[S]\text{Feed} - [S]\text{Permeate}}{[S]\text{Feed}} \times 100$$

Where [S] denotes molar concentration of solute that could be either formate or total carbonate.

Expected results are summarized below:

GE-Desal DK Membrane

| | % Rejection | | |
|---|---|---|---|
| Feed pH | Total carbonate | Formate | Permeabiility L/$m^2$ h bar |
| 7 | 11.4 | 2.2 | 1.72 |
| 9 | 30.3 | −9.7 | 1.07 |
| 11 | 81.8 | −46.3 | 0.36 |

Dow-Filmtec NF270 Membrane

| | % Rejection | | |
|---|---|---|---|
| Feed pH | Total carbonate | Formate | Permeabiility L/$m^2$ h bar |
| 7 | 11.0 | 2.6 | 1.91 |
| 9 | 29.5 | −5.4 | 1.20 |
| 11 | 80.1 | −43.8 | 0.44 |

Prophetic Example 6

A single permeation test could be performed with DK membrane, using a formate-enriched Feed solution comprising 1.2M $KHCO_3$+1.2M K-formate. The test could be done at pH 11 and all other conditions would be as in the above Example 1.

Such a test would likely give 79.9% and −33.8% rejection for total carbonate and formate, respectively. The permeability would be 0.32 L/$m^2$ h bar.

Example 7

The same cell as in Examples 1, 2, and 3 was used, except for using 701 gm of tin shot (0.3-0.6 mm diameter) media with an electroless plated indium coating as the cathode. The cathode compartment thickness was 0.875 inches.

In this test run, the system was operated with a catholyte composition containing 1.40 molar potassium bicarbonate (120 gm/L $KHCO_3$), which was sparged with carbon dioxide to an ending pH of 8.0

The cell was operated in a batch condition with no overflow for the first 7.3 hrs, and then a 1.40 molar potassium bicarbonate feed was introduced into the catholyte at a rate of about 1.4 mL/min, with the overflow collected and measured, and a sample of the loop was collected for formate concentration analysis.

Operating Conditions:

Batch Catholyte Recirculation Run

Anolyte Solution: 0.92 M $H_2SO_4$

Catholyte Solution: 1.4 M $KHCO_3$

Catholyte flow rate: 3.2 LPM

Applied cell current: 6 amps (6,000 mA)

Catholyte pH range: Dropping slowly from around a pH of 8 linearly with time during the run to a final pH of 7.50

Results:

Cell voltage range: 3.98-3.82 volts

Run time: Batch mode: 7.3 hours

Feed and product overflow: 7.3 hours to end of run at 47 hours.

The formate Faradaic efficiency was between 42% and 52% during the batch run period where the formate concentration went up to 10,490 ppm. During the feed and overflow period, the periodic calculated efficiencies varied between 32% and 49%. The average conversion efficiency was about 44%. The formate concentration varied between 10,490 and 48,000 ppm during the feed and overflow period. The cell voltage began at around 4.05 volts, ending up at 3.80 volts.

Example 8

Electrolyses were performed using a 3-compartment glass cell of roughly 80 mL total volume. The cell was constructed to be gas tight with Teflon bushings. The compartments were separated by 2 glass frits. A 3-electrode assembly was employed. One compartment housed the working electrode and the reference electrode (Accumet silver/silver chloride) which contained the aqueous electrolyte and catalyst as stated. The center compartment also contained the electrolyte and catalyst solution as stated. The third compartment was filled with 0.5 molar $K_2SO_4$ aqueous electrolyte solution sparged with $CO_2$ with a pH of about 4.5 and housed the counter electrode (TELPRO (Stafford, Tex.)—Mixed Metal Oxide Electrode). The working electrode compartment was purged with carbon dioxide during the experiment. The solutions were measured by ion chromatography for formic acid, analyzing the solution before (a blank) and after electrolysis. The tests were conducted under potentiometric conditions using a 6 channel Arbin Instruments MSTAT, operating at −1.46 or −1.90 volts vs. an SCE reference electrode for about 1.5 hrs.

| Cathode Evaluated | Experiment Designation | Formate Produced (ppm) | Formate Yield % | Applied Potential (volts) | Current (ma) | Time (hrs) |
|---|---|---|---|---|---|---|
| Electroplated indium on tin foil | DK80 | 1,818 | 75.8 | −1.9 | 50 | 1.5 |
| Electroplated indium on tin foil | DK82 | 1,956 | 64.0 | −1.9 | 58.5 | 1.5 |
| Untreated tin foil | DK80 | 1,260 | 54.3 | −1.9 | 44.5 | 1.5 |
| Electroplated indium on copper foil | DK83 | 1,887 | 31.7 | −1.9 | 123 | 1.5 |
| Tin foil (untreated) | DK80 | 604 | 18.0 | −1.9 | 54.8 | 1.5 |
| Copper screen with electroless indium coating | DK79 | 1,813 | 30.6 | −1.46 | 97.9 | 1.5 |
| Copper screen with electroless indium annealed at 200° C. | DK78 | 1,387 | 43.9 | −1.46 | 63.6 | 1.5 |

Example 9

The same cell as in Examples 1, 2, and 3 was used, except for using 890.5 gm of tin shot (3 mm diameter) media and with a tin foil coating as the cathode. The cathode compartment thickness was 1.25 inches and the system was operated in a batch mode with no feed input. Carbon dioxide was sparged to saturate the solution in the catholyte disengager.

Packed Tin Bed Cathode Detail:
Weight: 890.5 gm tin shot
Tin shot: 3 mm average size
Total compartment volume: 369 $cm^3$
Calculated tin bead surface area: 4,498 $cm^2$
Calculated packed bed cathode specific surface area: 12.2 $cm^2/cm^3$
Calculated packed bed void volume: 34.6%

In this test run, the system was operated with a catholyte composition containing 1.40 molar potassium bicarbonate (120 gm/L $KHCO_3$), which was sparged with $CO_2$ to an ending pH of about 8.0

The cell was operated in a batch condition with no overflow and a sample of the catholyte loop was collected for formate concentration analysis periodically.

Operating Conditions:
Batch Catholyte Recirculation Run
Anolyte Solution: 0.92 M $H_2SO_4$
Catholyte Solution: 1.4 M $KHCO_3$
Catholyte flow rate: 3.0 LPM (upflow)
Catholyte flow velocity: 0.068 ft/sec Applied cell current: 6 amps (6,000 mA)
Catholyte pH range: Increasing slowly from around a pH of 7.62 linearly with time during the run to a final pH of 7.73

Figure 11:
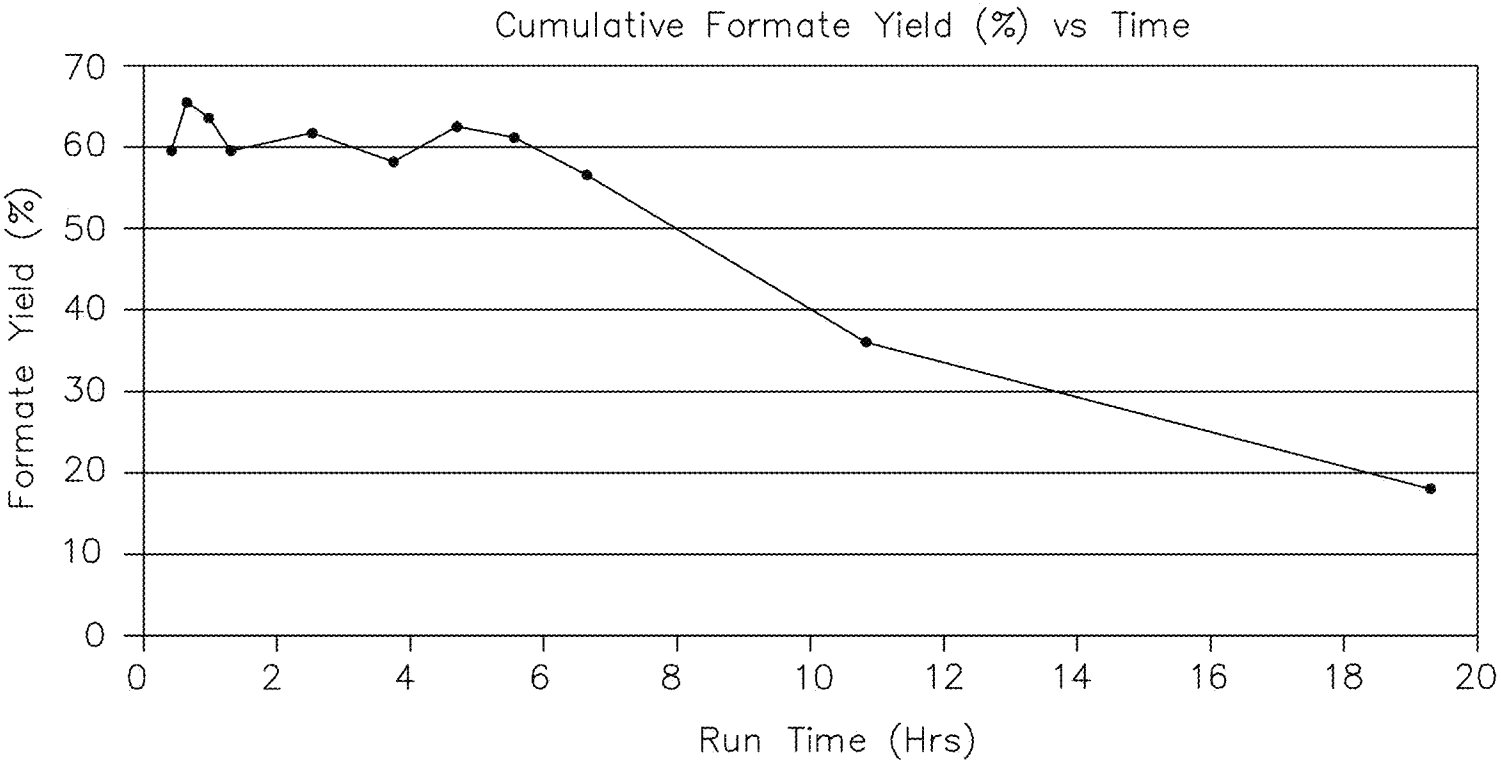
FIG. 11 is a chart illustrating cumulative formate yield versus time in accordance with an embodiment described with reference to Example 9 of the present disclosure.
Figure 12:
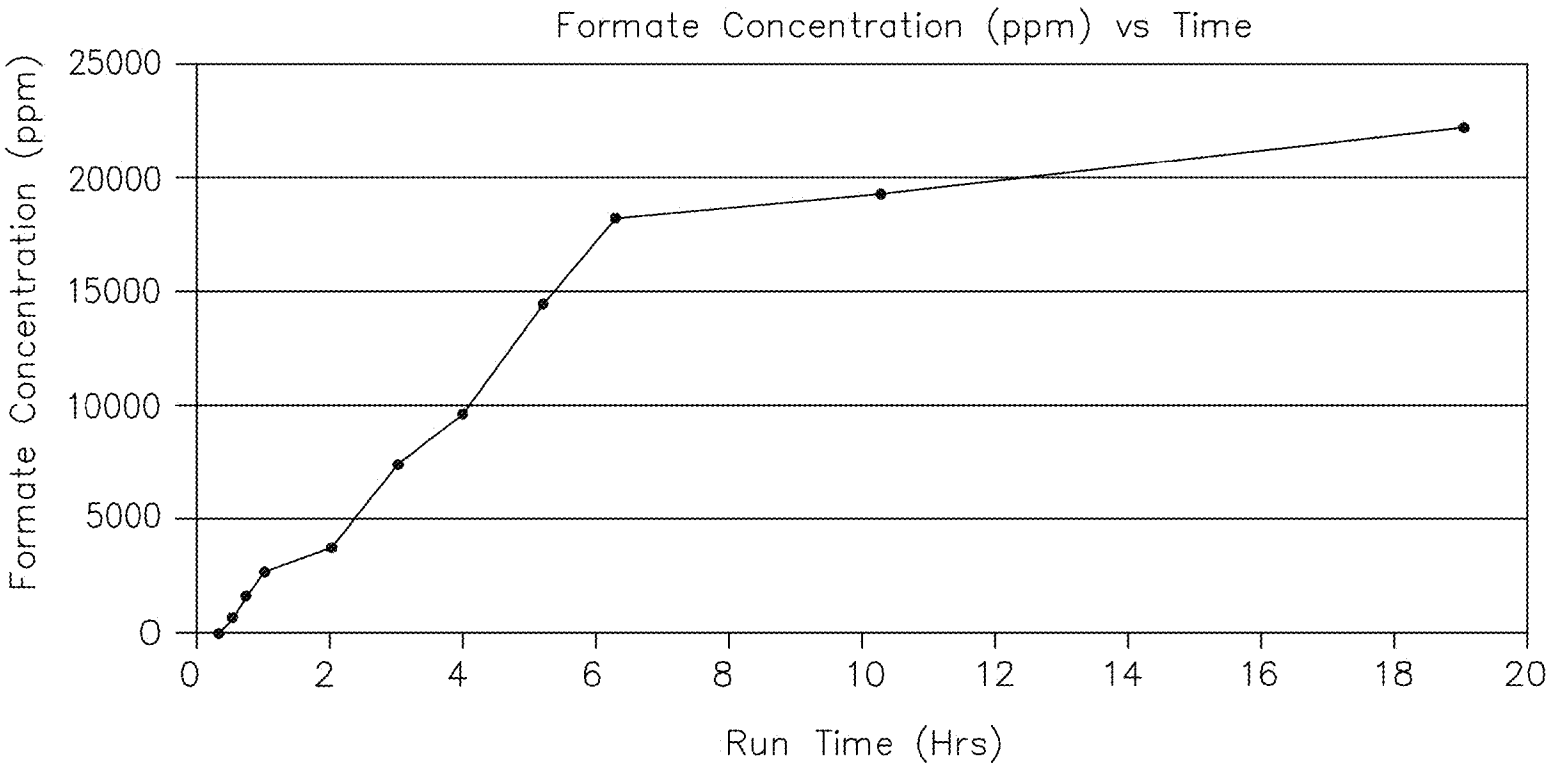
FIG. 12 is a chart illustrating formate concentration versus time in accordance with an embodiment described with reference to Example 9 of the present disclosure.

Results:
Cell voltage range: Started at 3.84 volts, and slowly declined to 3.42 volts
Run time: Batch mode, 19 hours The formate Faradaic efficiency started at about 65% and declined after 10 hours to 36% and to about 18.3% after 19 hours. The final formate concentration ended up at 20,500 ppm at the end of the 19 hour run. See FIGS. 11 and 12.

Example 10

The same cell as in Examples 1, 2, and 3 was used, except for using 805 gm of indium coated tin shot (3 mm diameter) media and with a 0.010 inch (0.0254 cm) thickness indium foil mounted on the 316L SS back conductor plate using a conductive silver epoxy as the cathode. The cathode compartment thickness was 1.25 inches and the system was operated in a batch mode with no feed input. Carbon dioxide was sparged to saturate the solution in the catholyte disengager. The tin shot was electrolessly plated with indium in the same method as used in Examples 1-4 on the tin-coated copper mesh. The indium coating was estimated to be about 0.5-1.0 microns in thickness.

Indium-Coated Tin Shot Packed Bed Cathode Detail:
Weight: 890.5 gm, indium coating on tin shot
Indium coated tin shot: 3 mm average size
Total compartment volume: 369 $cm^3$
Calculated tin bead surface area: 4498 $cm^2$
Packed bed cathode specific surface area: 12.2 $cm^2/cm^3$
Packed bed void volume: 34.6%

In this test run, the system was operated with a catholyte composition containing 1.40 molar potassium bicarbonate (120 gm/L $KHCO_3$), which was sparged with $CO_2$ to an ending pH of about 8.0

The cell was operated in a batch condition with no overflow and a sample of the catholyte loop was collected for formate concentration analysis periodically.

Operating Conditions:
Batch Catholyte Recirculation Run
Anolyte Solution: 0.92 M $H_2SO_4$
Catholyte Solution: 1.4 M $KHCO_3$
Catholyte flow rate: 3.0 LPM (upflow)
Catholyte flow velocity: 0.068 ft/sec
Applied cell current: 6 amps (6,000 mA)
Catholyte pH range: Decreased slowly from around a pH of 7.86 linearly with time during the run to a final pH of 5.51

Figure 13:
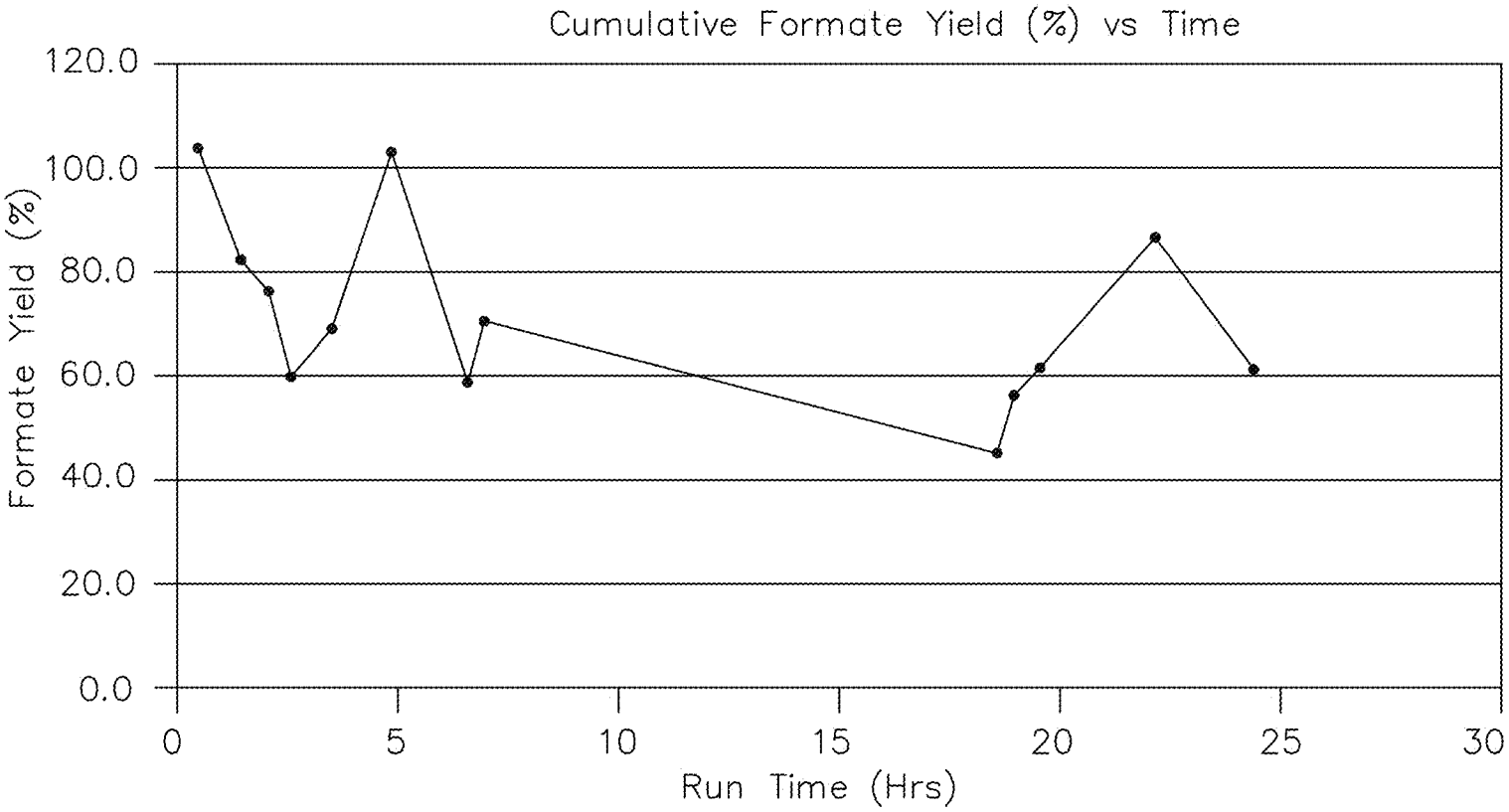
FIG. 13 is a chart illustrating cumulative formate yield versus time in accordance with an embodiment described with reference to Example 10 of the present disclosure.
Figure 14:
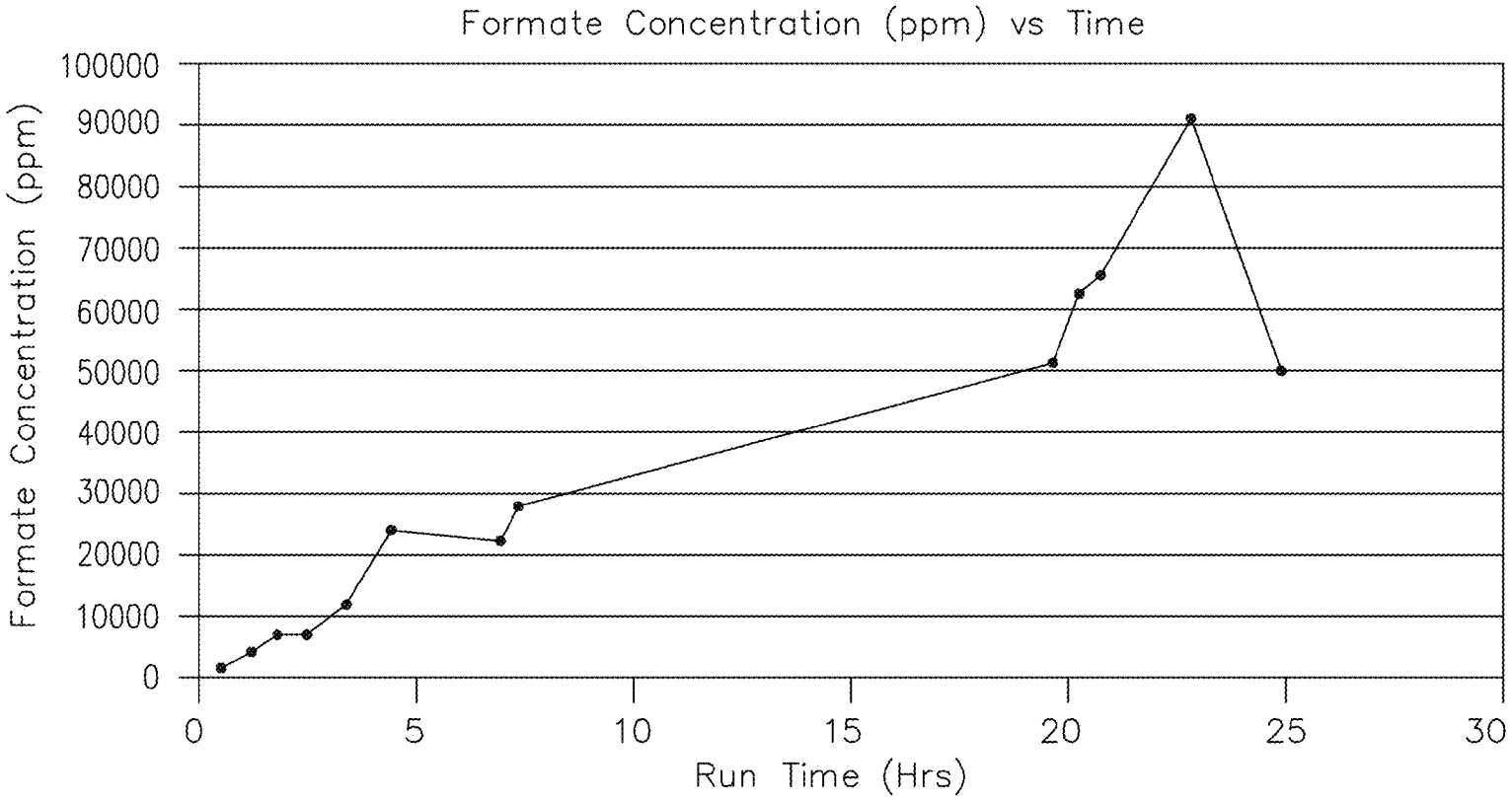
FIG. 14 is a chart illustrating formate concentration versus time in accordance with an embodiment described with reference to Example 10 of the present disclosure.

Results:
Cell voltage range: Started at 3.68 volts, and slowly declined to 3.18 volts
Run time Batch mode, 24 hours The formate Faradaic efficiency started at about 100% and varied between 60% to 85%, ending at about 60% after 24 hours. The final formate concentration ended up at about 60,000 ppm at the end of the 24 hour run. Dilution error of the samples at the high formate concentrations may have provided the variability seen in the yield numbers. See FIGS. 13 and 14.

Example 11

The same cell as in Examples 1, 2, and 3 was used with a newly prepared indium on tin electrocatalyst coating on a copper mesh cathode. The prepared cathode had calculated surface areas of about 3,171 $cm^2$, for an area about 31 times the flat cathode plate area, with a 91% void volume, and specific surface area of 12.3 $cm^2/cm^3$.

In this test run, the system was operated with a catholyte composition containing 1.40 M potassium bicarbonate (120 gm/L $KHCO_3$), which was sparged with $CO_2$ to an ending pH of 7.8 before being used.

The cells were operated in a recirculating batch mode for the first 8 hours of operation to get the catholyte formate ion concentration up to about 20,000 ppm, and then a fresh feed of 1.4 M potassium bicarbonate was metered into the catholyte at a feed rate of about 1.2 mL/min. The overflow volume was collected and volume measured, and the overflow and catholyte loop sample were sampled and analyzed for formate by ion chromatography.

Operating Conditions:

Cathode: Electroless indium on tin on a copper mesh substrate

Continuous Feed with Catholyte Recirculation Run—11.5 days

Anolyte Solution: 0.92 M $H_2SO_4$

Catholyte Solution: 1.4 M $KHCO_3$

Catholyte flow rate: 3.2 LPM

Catholyte flow velocity: 0.09 ft/sec

Applied cell current: 6 amps (6,000 mA)

Figure 15:
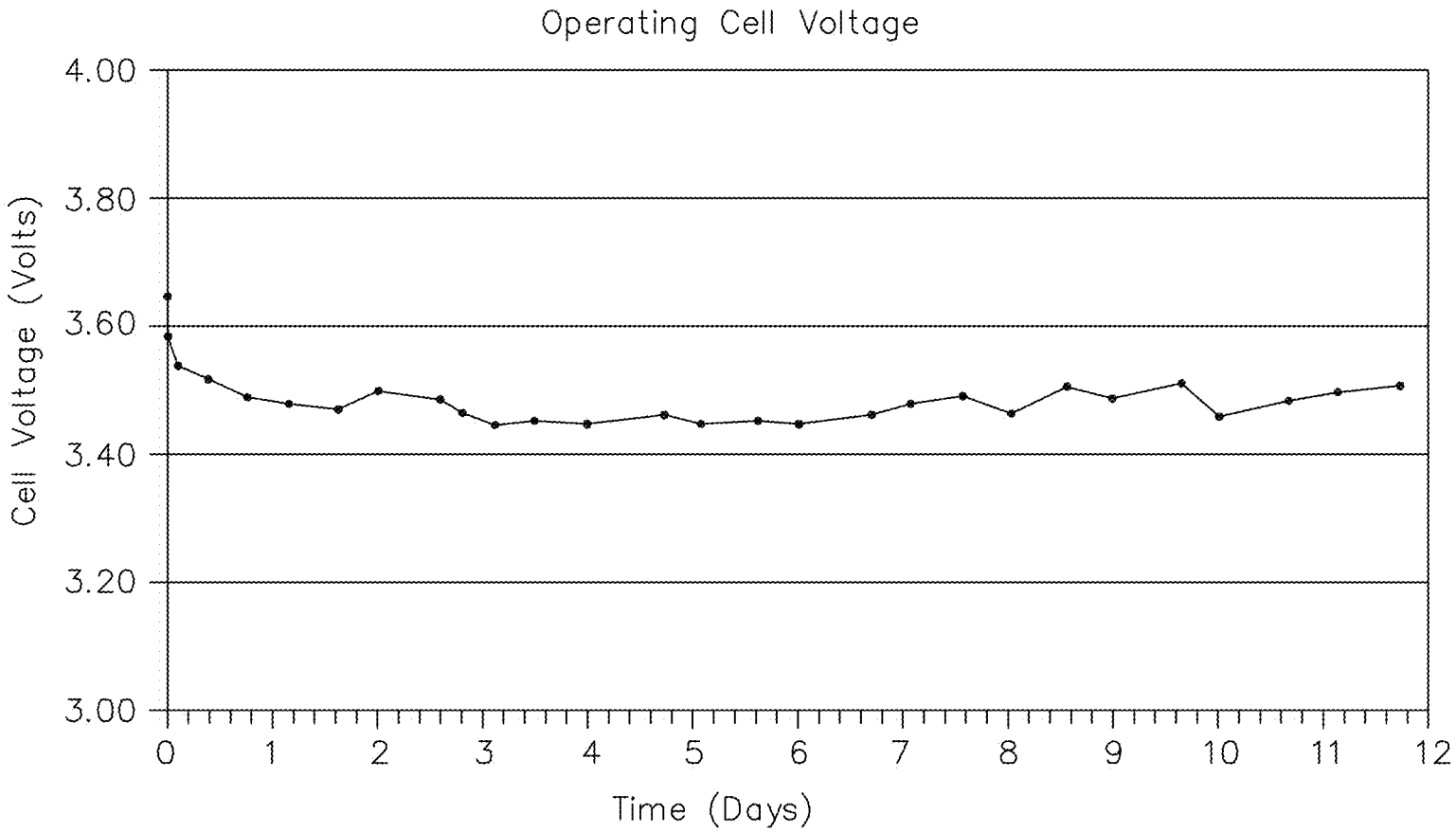
FIG. 15 is a chart illustrating operating cell voltage versus time in accordance with an embodiment described with reference to Example 11 of the present disclosure.

Results:

Cell voltage versus time: FIG. 15 illustrates results of cell voltage versus time, displaying a stable operating voltage of about 3.45 volts over the 11.5 days after the initial start-up.

Continuous Run time: 11.5 days

Figure 16:
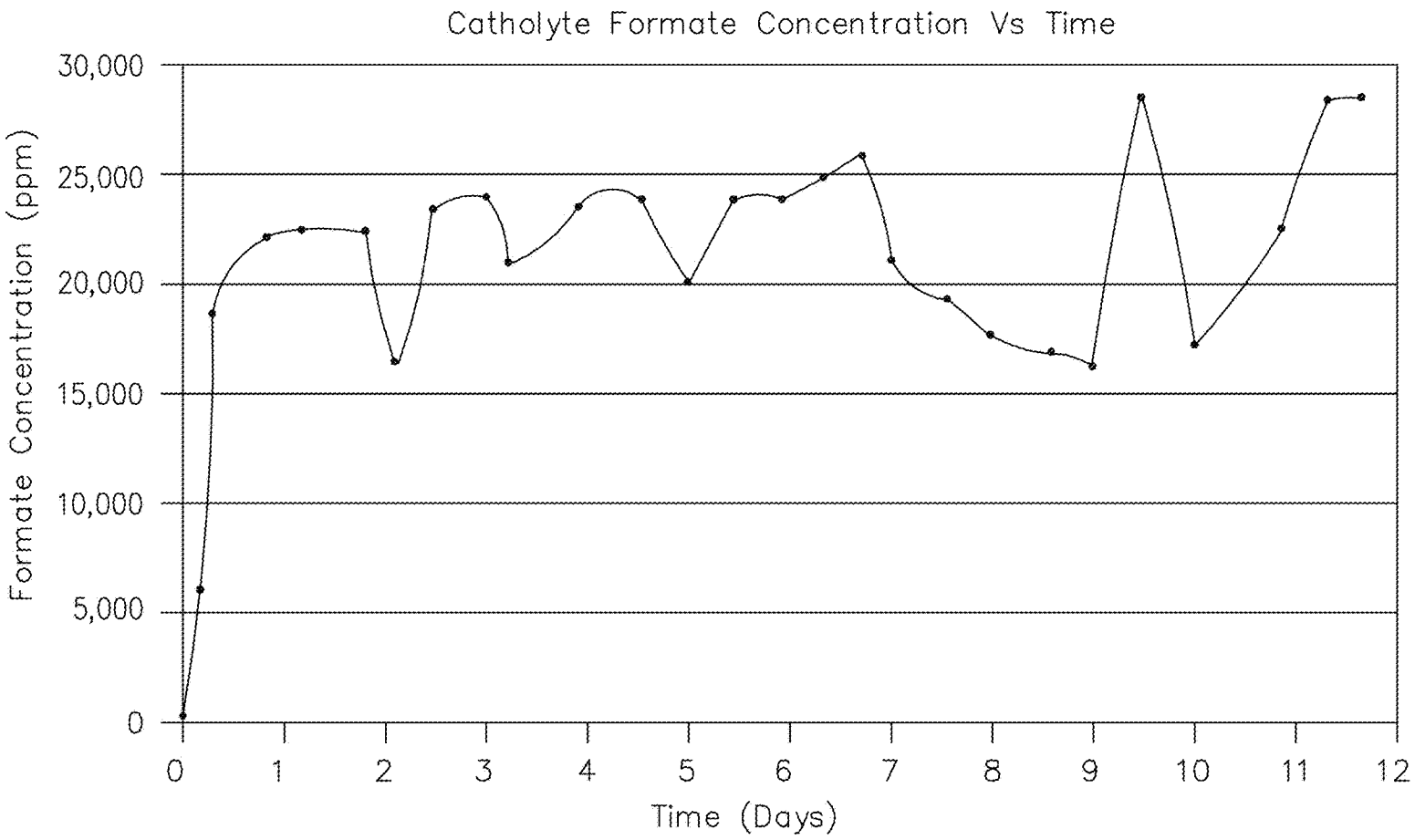
FIG. 16 is a chart illustrating catholyte formate concentration versus time in accordance with an embodiment described with reference to Example 11 of the present disclosure.

Formate Concentration Versus Time: FIG. 16 shows results of the formate concentration versus time.

Figure 17:
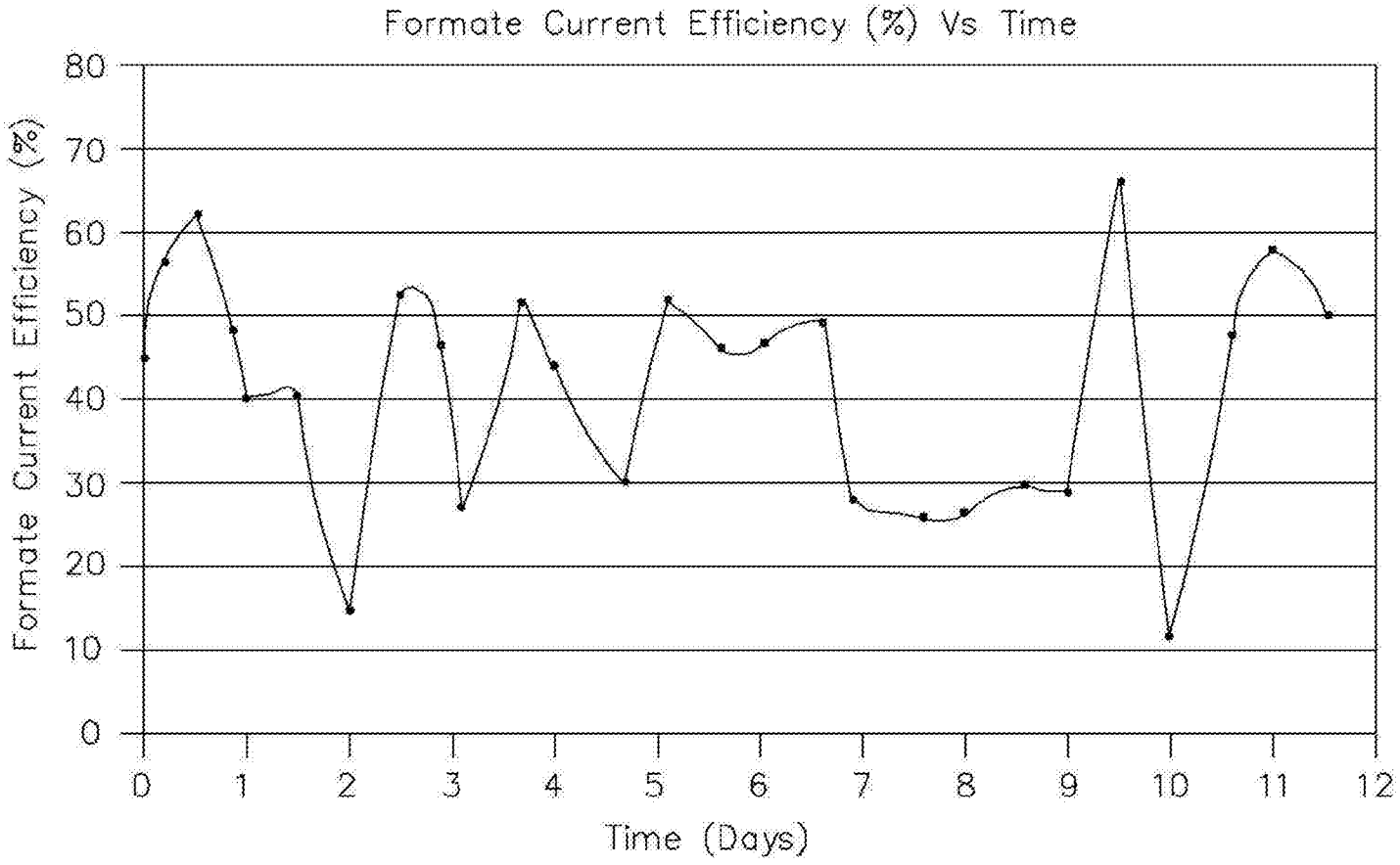
FIG. 17 is a chart illustrating formate current efficiency versus time in accordance with an embodiment described with reference to Example 11 of the present disclosure.

Formate Faradaic yield: FIG. 17 illustrates the calculated formate current efficiency versus time measuring the formate yield from the collected samples.

Final formate concentration: About 28,000 ppm.

Figure 18:
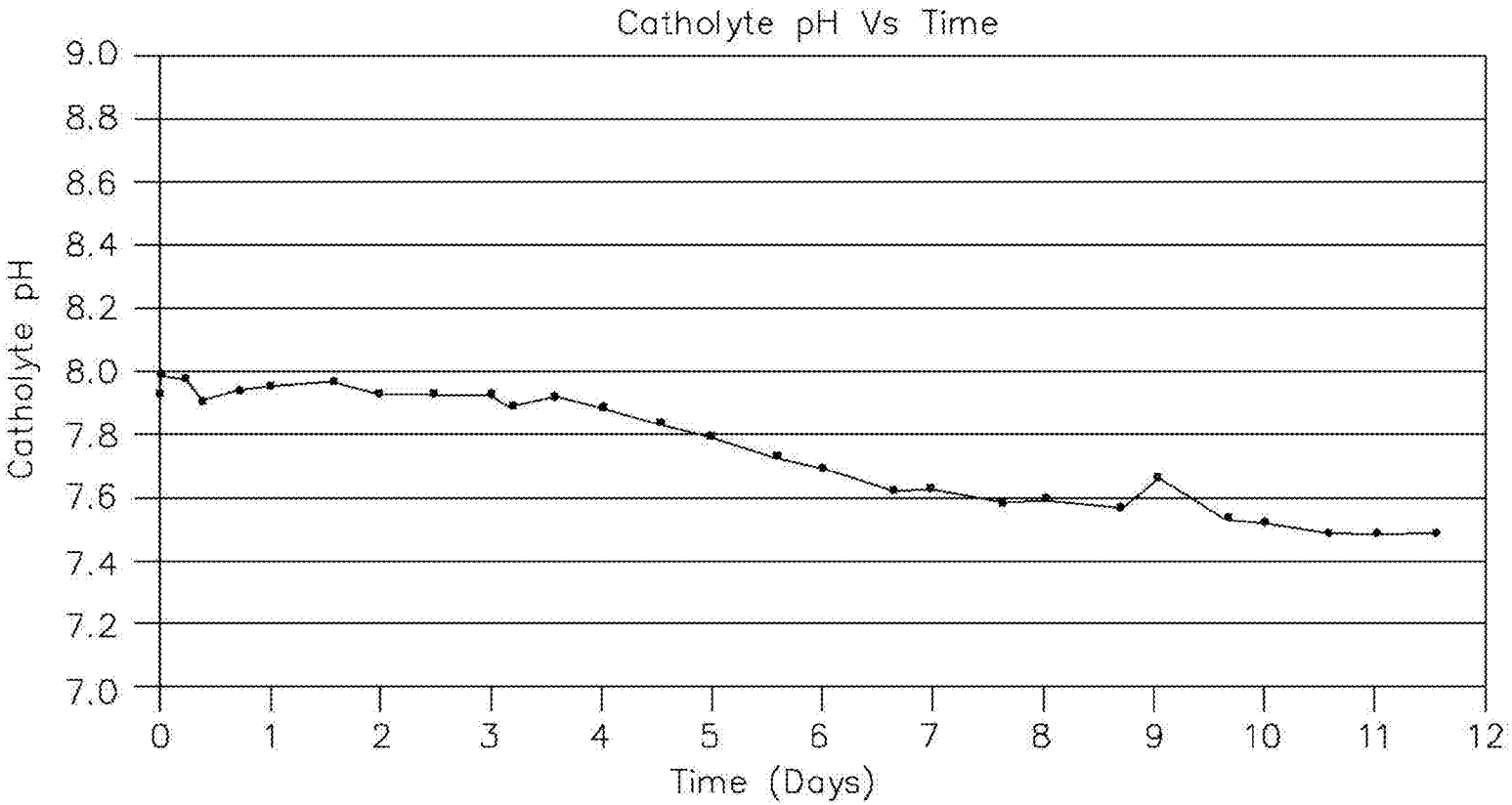
FIG. 18 is a chart illustrating catholyte pH versus time in accordance with an embodiment described with reference to Example 11 of the present disclosure.

Catholyte pH: FIG. 18 illustrates the catholyte pH change over the 11.5 days, which slowly declined from a pH of 7.8 to a pH value of 7.5. The feed rate was not changed during the run, but could have been slowly increased or decreased to maintain a constant catholyte pH in any optimum operating pH range.

Example 12

The same cell as in Examples 1, 2, and 3 was used with a newly prepared indium on tin electrocatalyst coating on a copper mesh cathode. The prepared cathode had calculated surface areas of about 3,171 $cm^2$, for an area about 31 times the flat cathode plate area, with a 91% void volume, and specific surface area of 12.3 $cm^2/cm^3$.

In this test run, the system was operated with a catholyte composition containing 1.40 M potassium bicarbonate (120 gm/L $KHCO_3$), which was sparged with $CO_2$ to an ending pH of 7.8 before being used.

The cells were operated in a recirculating batch mode for the first 8 hours of operation to get the catholyte formate ion concentration up to about 20,000 ppm, and then a fresh feed of 1.4 M potassium bicarbonate was metered into the catholyte at a feed rate of about 1.2 mL/min. The overflow volume was collected and volume measured, and the overflow and catholyte loop sample were sampled and analyzed for formate by ion chromatography.

Operating Conditions:

Cathode: Electroless indium on tin on a copper mesh substrate

Continuous Feed with Catholyte Recirculation Run—21 days

Anolyte Solution: 0.92 M $H_2SO_4$

Catholyte Solution: 1.4 M $KHCO_3$

Catholyte flow rate: 3.2 LPM

Catholyte flow velocity: 0.09 ft/sec

Applied cell current: 6 amps (6,000 mA)

Results:

Cell voltage versus time: The cell showed a higher operating voltage of about 4.40 volts, higher than all of our other cells, because of an inadequate electrical contact pressure of the cathode against the indium foil conductor back plate. The cell maintained operation for an extended run.

Continuous Run time: 21 days

Figure 19:
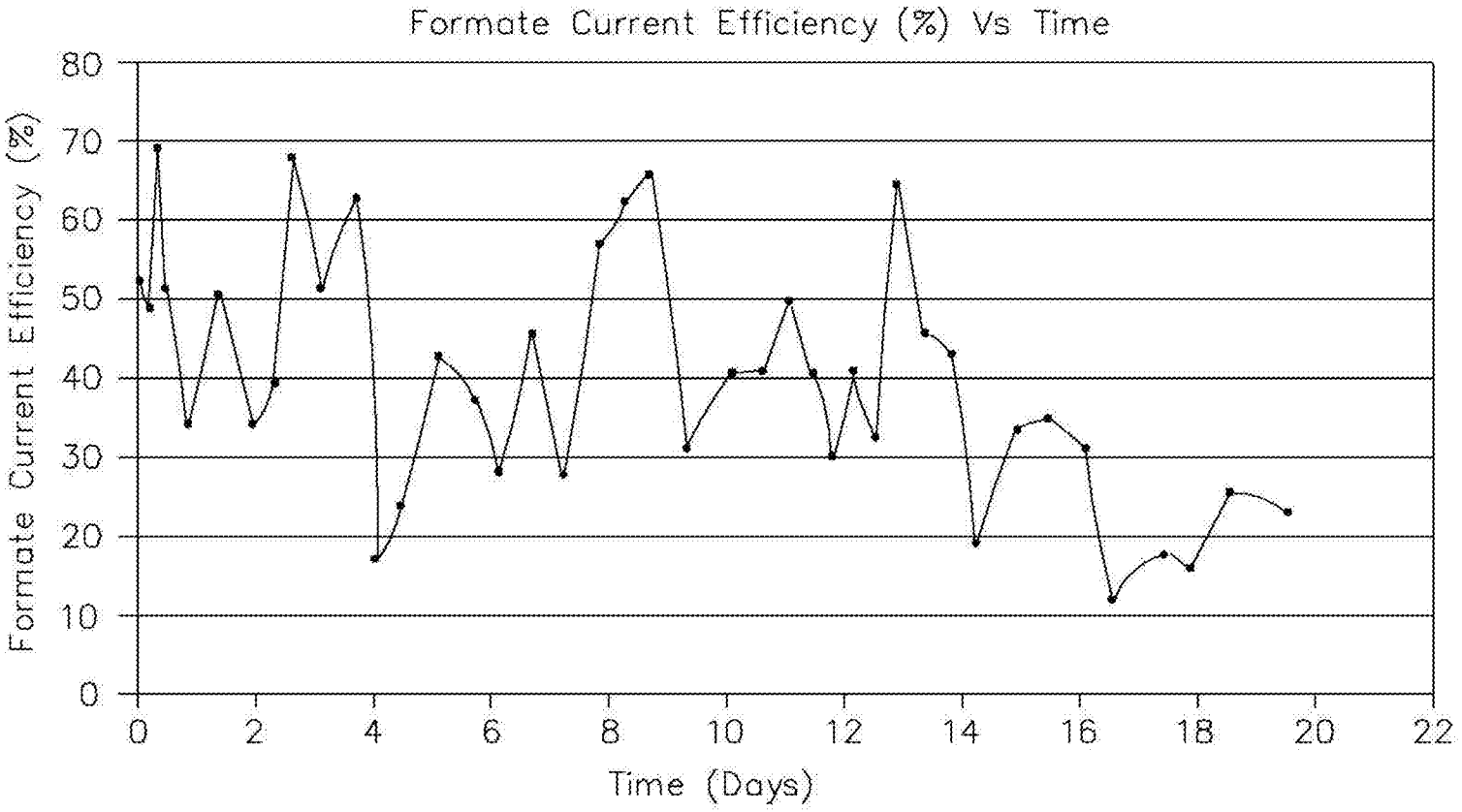
FIG. 19 is a chart illustrating formate current efficiency versus time in accordance with an embodiment described with reference to Example 12 of the present disclosure.

Formate Faradaic yield: FIG. 19 illustrates calculated formate current efficiency versus time measuring the formate yield from the collected samples. The formate Faradaic current efficiency declined down into the 20% range after 16 days.

Figure 20:
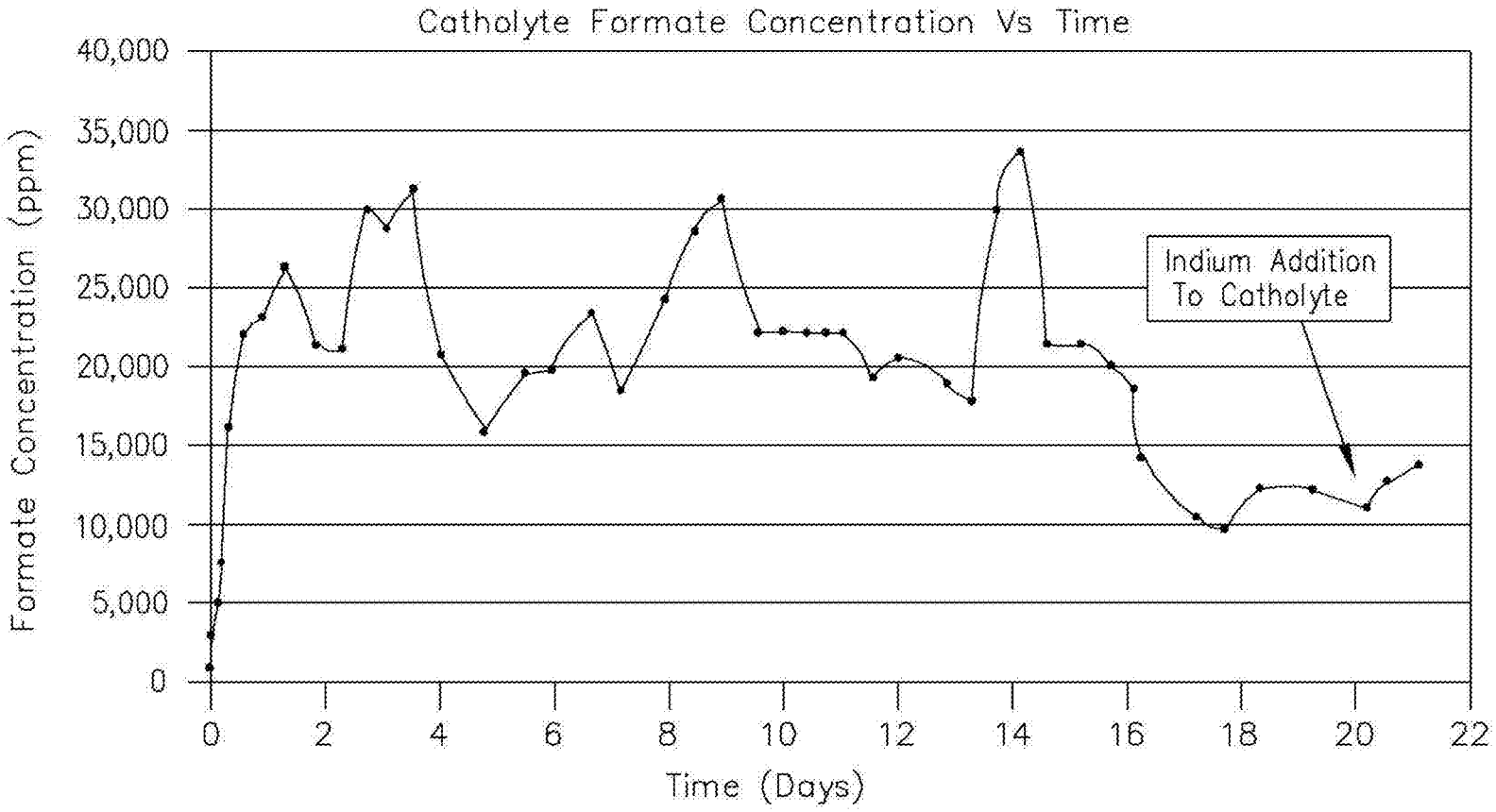
FIG. 20 is a chart illustrating catholyte formate concentration versus time in accordance with an embodiment described with reference to Example 12 of the present disclosure.

Formate Concentration Versus Time: FIG. 20 illustrates results of the formate concentration versus time. On day 21, 0.5 gm of indium (III) carbonate was added to the catholyte while the cell was still operating at the 6 ampere operating rate. The formate concentration in the catholyte operating loop was 11,330 ppm before the indium addition, which increased to 13,400 ppm after 8 hours, and increased to 14,100 ppm after 16 hours when the unit was shut down after 21 days of operation.

Figure 21:
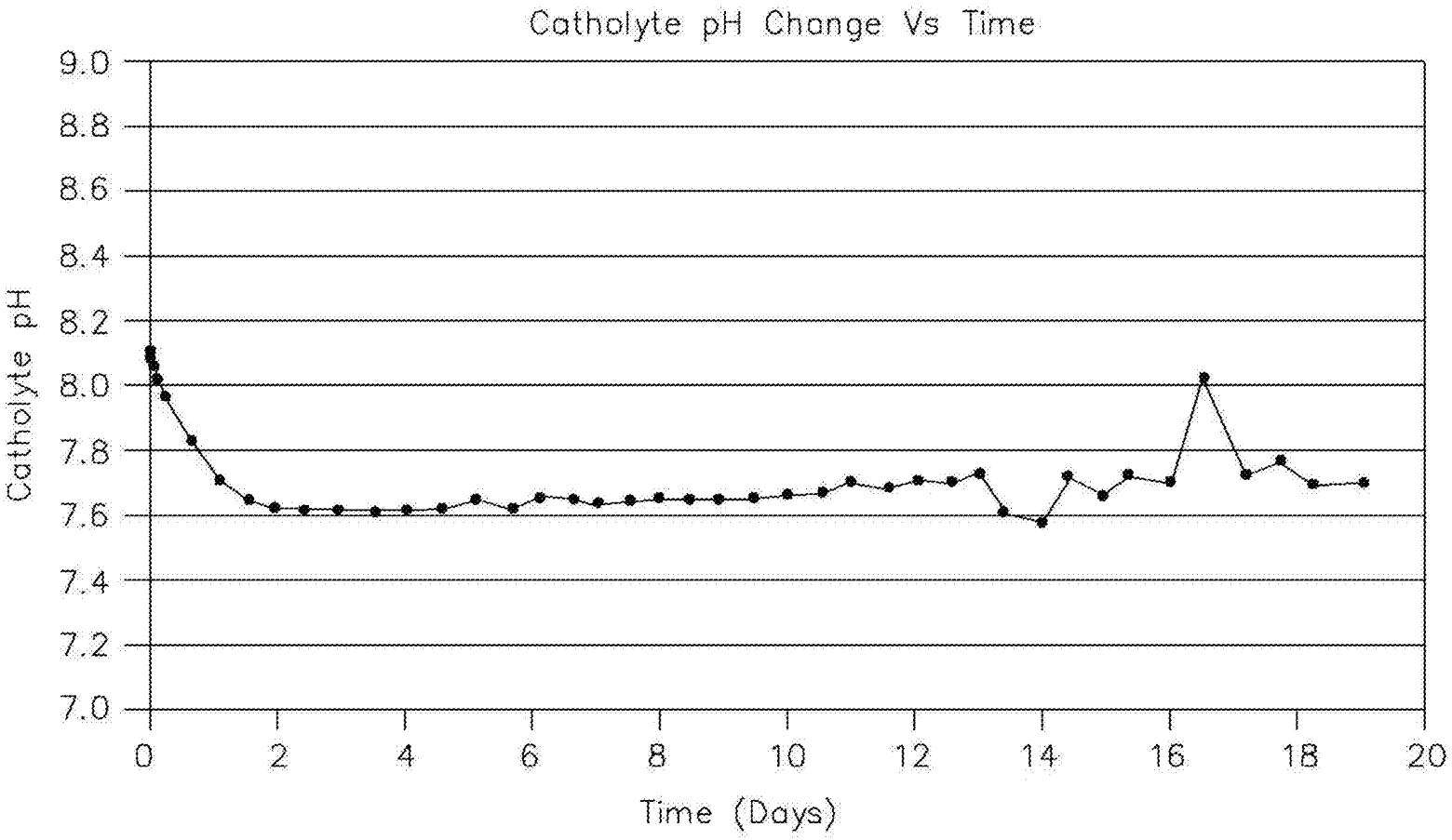
FIG. 21 is a chart illustrating catholyte pH versus time in accordance with an embodiment described with reference to Example 12 of the present disclosure.

Catholyte pH: FIG. 21 illustrates the catholyte pH change over the continuous operation period, which operated in the 7.6 to 7.7 pH range except for an outlier data point near day 16 when the feed pump had stopped pumping. The feed rate was not changed during the run, but could have been increased or decreased to maintain a constant pH operation in an optimum range.

It is believed that the present disclosure and many of its attendant advantages will be understood by the foregoing description, and it will be apparent that various changes may be made in the form, construction and arrangement of the components thereof without departing from the scope and spirit of the disclosure or without sacrificing all of its material advantages. The form herein before described being merely an explanatory embodiment thereof, it is the intention of the following claims to encompass and include such changes.

What is claimed is:

1. A method for electrochemical reduction of carbon dioxide into products, comprising:

(A) introducing an acidic anolyte to a first compartment of a first electrochemical cell, the first compartment including an anode;

(B) introducing a catholyte including an alkali metal bicarbonate to a second compartment of the first electrochemical cell, the catholyte saturated with carbon dioxide, the second compartment including a high surface area cathode, the high surface area cathode including a coating containing indium and having a void volume of between about 30% to 98%, at least a portion of the catholyte including the alkali metal bicarbonate being recycled;

(C) applying an electrical potential between the anode and the cathode sufficient to reduce the carbon dioxide to an alkali metal formate;

(D) introducing the alkali metal formate to an ion exchange compartment of a second electrochemical cell;

(E) applying an electrical potential between an anode of the second electrochemical cell and a cathode of the second electrochemical cell sufficient to produce at least formic acid and an alkali metal hydroxide;

(F) introducing the alkali metal hydroxide with carbon dioxide to generate at least a portion of the alkali metal bicarbonate introduced to the second compartment of the first electrochemical cell; and (G) separating the alkali metal formate from the alkali metal bicarbonate of the catholyte of the first electrochemical cell with a nano-filtration system, wherein the nano-filtration system separates monovalent anions from divalent anions.

2. The method of claim 1, wherein separating the alkali metal formate from the alkali metal bicarbonate of the catholyte of the first electrochemical cell with a nano-filtration system comprises:

introducing the alkali metal bicarbonate of the catholyte to an alkali metal hydroxide to convert at least a portion of the alkali metal bicarbonate to an alkali metal carbonate; and separating the alkali metal carbonate from the alkali metal formate with a nano-filtration unit.

3. The method of claim 2, further comprising:

introducing the alkali metal carbonate with the alkali metal hydroxide and with carbon dioxide to generate at least a portion of the alkali metal bicarbonate introduced to the second compartment of the first electrochemical cell.

4. The method of claim 1, wherein at least a portion of the alkali metal hydroxide is generated by one or more of the first electrochemical cell and the second electrochemical cell.

5. The method of claim 1, wherein the formic acid is generated in the ion exchange compartment of the second electrochemical cell.

6. The method of claim 1, wherein the alkali metal hydroxide is generated in a cathode compartment of the second electrochemical cell.

7. The method of claim 1, wherein the high surface area cathode has a specific surface area of greater than 2 $cm^2/cm^3$.

8. The method of claim 1, wherein the acidic anolyte includes sulfuric acid.

9. The method of claim 1, further comprising:

generating a halogen selected from the group consisting of $F_2$, $Cl_2$, $Br_2$, and $I_2$ in at least one of the first compartment of the first electrochemical cell and the first compartment of the second electrochemical cell.

10. The method of claim 9, further comprising:

reacting the halogen with an organic compound to produce a halogenated product.

11. The method of claim 10, wherein the halogen is bromine.

12. The method of claim 9, wherein the halogen is bromine.

13. The method of claim 1, wherein the high surface area cathode includes from 5% to 99% as indium in alloy with bismuth.

* * * * *